US008085258B2

(12) United States Patent
Asano et al.

(10) Patent No.: US 8,085,258 B2
(45) Date of Patent: Dec. 27, 2011

(54) ORGANIC ELECTROLUMINESCENCE DISPLAY APPARATUS, DRIVING CIRCUIT FOR DRIVING ORGANIC ELECTROLUMINESCENCE LIGHT EMITTING PORTION, AND DRIVING METHOD FOR ORGANIC ELECTROLUMINESCENCE LIGHT EMITTING PORTION

(75) Inventors: Mitsuru Asano, Kanagawa (JP); Masatsugu Tomida, Kanagawa (JP); Hiroshi Fujimura, Aichi (JP)

(73) Assignee: Sony Corporation, Tokyo (JP)

( * ) Notice: Subject to any disclaimer, the term of this patent is extended or adjusted under 35 U.S.C. 154(b) by 818 days.

(21) Appl. No.: 12/219,991

(22) Filed: Jul. 31, 2008

(65) Prior Publication Data

US 2009/0046088 A1 Feb. 19, 2009

(30) Foreign Application Priority Data

Aug. 13, 2007 (JP) ..... 2007-210741

(51) Int. Cl.
*G09G 5/00* (2006.01)

(52) U.S. Cl. ..... 345/211; 345/76; 345/92; 345/212

(58) Field of Classification Search ..... 345/76–83, 345/90–100, 204–215; 315/169.1–169.4
See application file for complete search history.

(56) References Cited

U.S. PATENT DOCUMENTS 6,356,026 B1 * 3/2002 Murto ..... 315/111.81
6,693,388 B2 * 2/2004 Oomura ..... 315/169.3

FOREIGN PATENT DOCUMENTS

JP 2006-215213 8/2006

* cited by examiner

*Primary Examiner* — Vijay Shankar
(74) *Attorney, Agent, or Firm* — Rader Fishman & Grauer PLLC

(57) ABSTRACT

A driving circuit for driving an organic electroluminescence light emitting portion includes: a driving transistor of the n channel type having source/drain regions, a channel formation region and a gate electrode; an image signal writing transistor having source/drain regions, a channel formation region and a gate electrode; and a capacitor element. A first voltage for supplying current toward the organic electroluminescence light emitting portion through the driving transistor and a second voltage for preventing a potential difference between the second node and a cathode electrode provided on the organic electroluminescence light emitting portion from exceeding a threshold voltage of the organic electroluminescence light emitting portion are selectively applied from the power supply section to the first one of the source/drain regions of the driving transistor. An LDD (Lightly Doped Drain) structure is formed adjacent the first one of the source/drain regions of the driving transistor.

14 Claims, 16 Drawing Sheets

FIG.5A [TP(2)$_{-1}$]
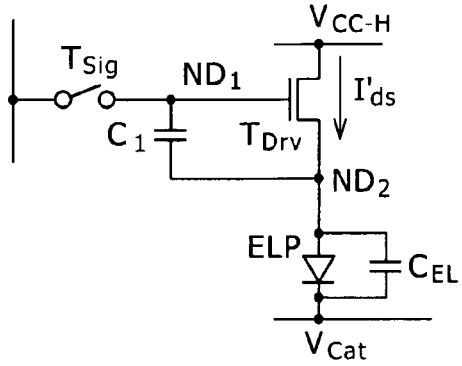
FIG.5B [TP(2)$_0$]
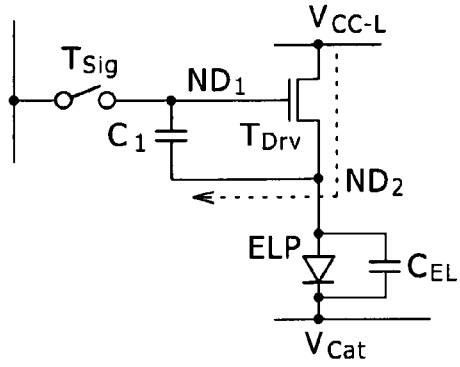
FIG.5C [TP(2)$_1$]
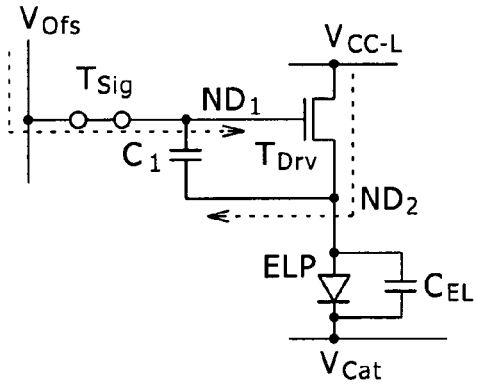
FIG.5D [TP(2)$_2$]
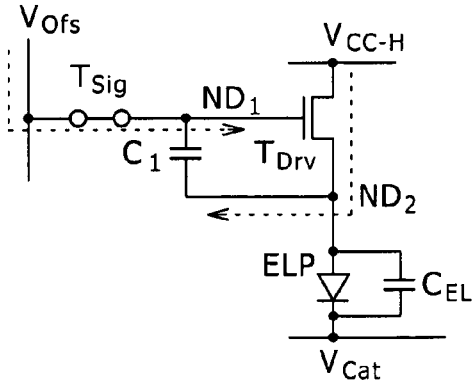
FIG.5E [TP(2)$_3$]
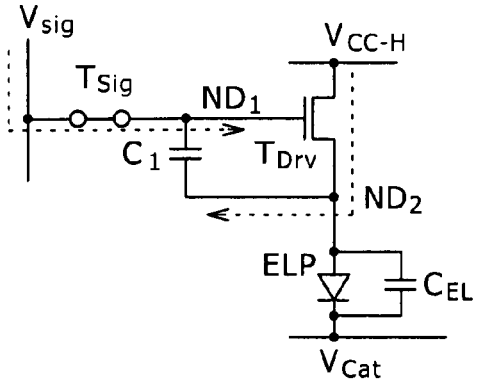
FIG.5F [TP(2)$_4$]
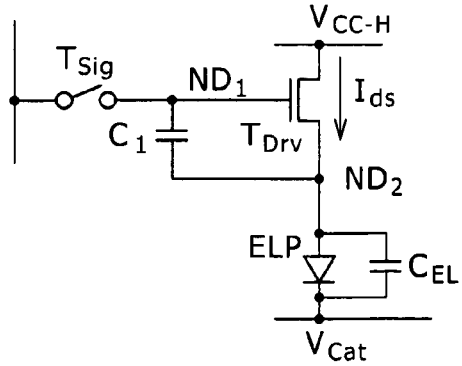

FIG. 10A [TP(3)-1]
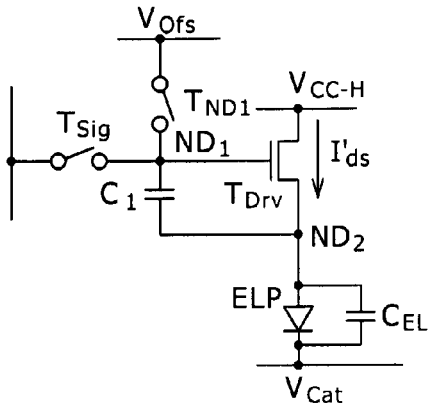
FIG. 10B [TP(3)0]
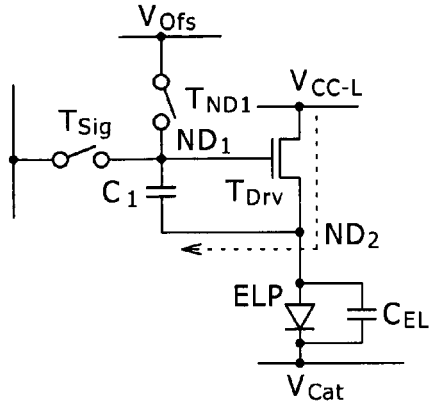
FIG. 10C [TP(3)1]
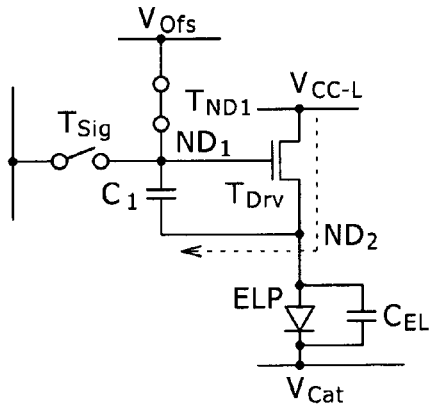
FIG. 10D [TP(3)2]
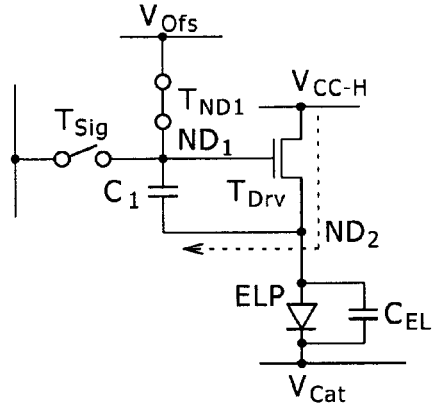
FIG. 10E [TP(3)4]
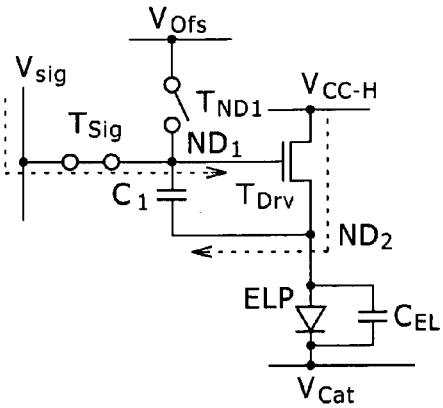
FIG. 10F [TP(3)5]
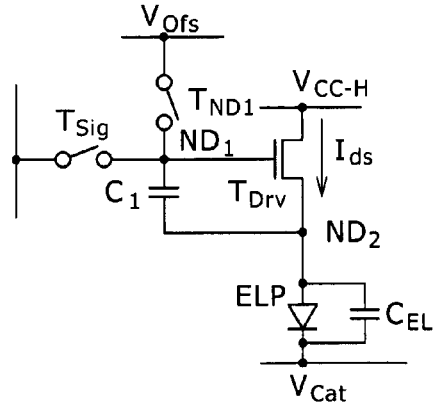

FIG. 15A [TP(5)-1]
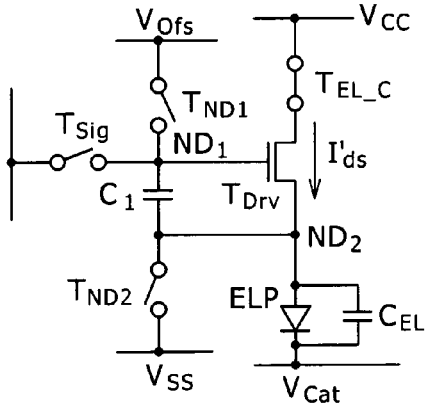
FIG. 15B [TP(5)1]
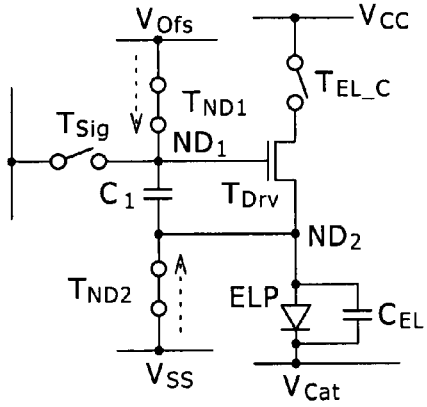
FIG. 15C [TP(5)1]
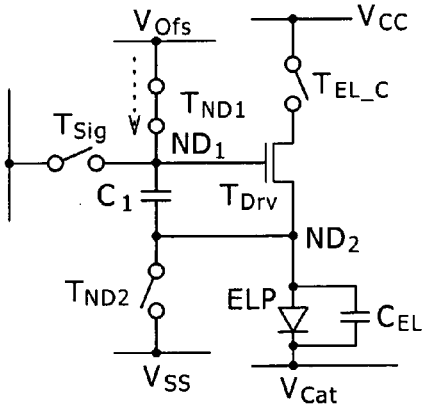
FIG. 15D [TP(5)2]
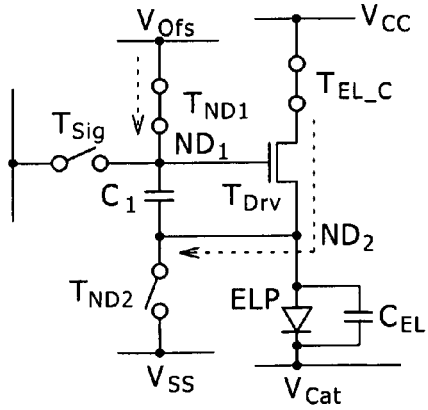

FIG. 16A [TP(5)3]
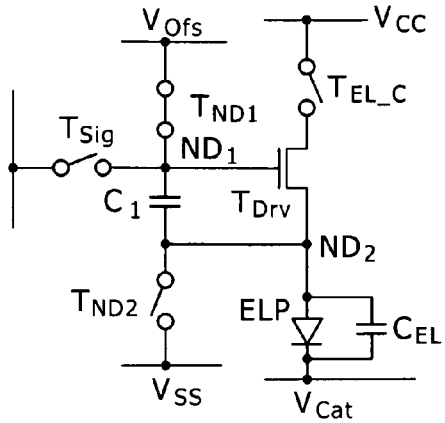
FIG. 16B [TP(5)4]
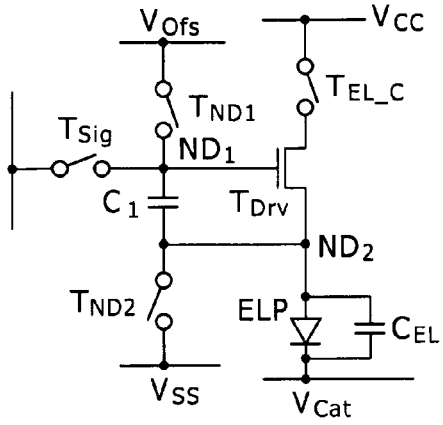
FIG. 16C [TP(5)5]
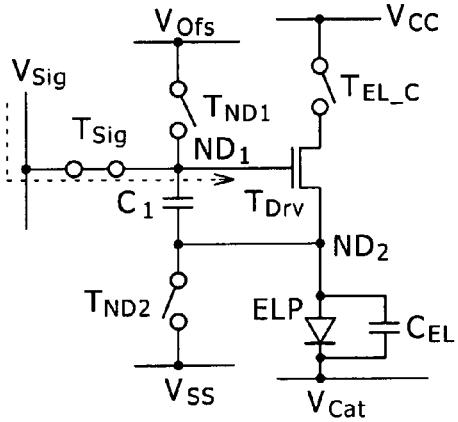
FIG. 16D [TP(5)6]
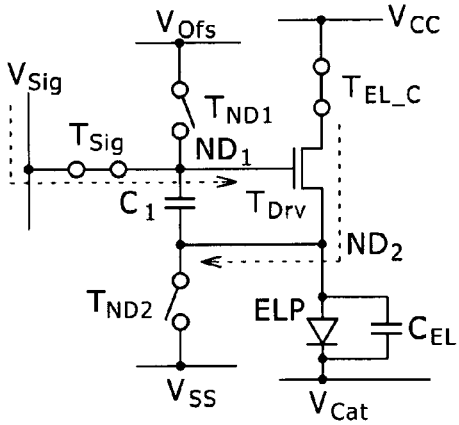
FIG. 16E [TP(5)7]
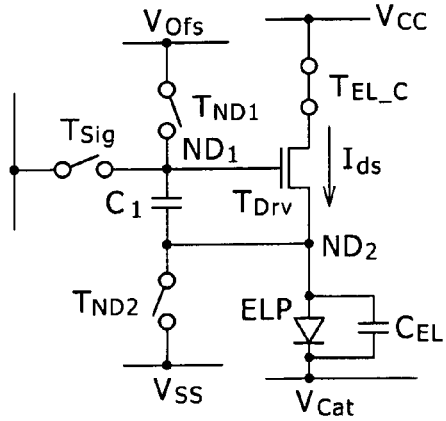

ORGANIC ELECTROLUMINESCENCE DISPLAY APPARATUS, DRIVING CIRCUIT FOR DRIVING ORGANIC ELECTROLUMINESCENCE LIGHT EMITTING PORTION, AND DRIVING METHOD FOR ORGANIC ELECTROLUMINESCENCE LIGHT EMITTING PORTION

CROSS REFERENCES TO RELATED APPLICATIONS

The present invention contains subject matter related to Japanese Patent Application JP 2007-210741 filed in the Japan Patent Office on Aug. 13, 2007, the entire contents of which being incorporated herein by reference.

BACKGROUND OF THE INVENTION

1. Field of the Invention

This invention relates to an organic electroluminescence display apparatus, a driving circuit for driving an organic electroluminescence light emitting portion and a driving method for an organic electroluminescence light emitting portion.

2. Description of the Related Art

In an organic electroluminescence display apparatus (hereinafter referred to as simply as organic EL display apparatus) which uses an electroluminescence device (hereinafter referred to merely as organic EL device) as a light emitting device, the luminance of the organic EL device is controlled by the value of electric current flowing through the organic EL device. Similarly as in a liquid crystal display apparatus, also in the organic EL display apparatus, a simple matrix method and an active matrix method are known as a driving method. The active matrix method has such various advantages that a high luminance image can be obtained although it has a drawback that the structure is complicated in comparison with the simple matrix method.

As a circuit for driving an organic electroluminescence light emitting portion (hereinafter referred to as light emitting portion) which is a component of the organic EL device, a driving circuit composed of five transistors and one capacitor element is known and disclosed, for example, in Japanese Patent Laid-Open No. 2006-215213. The driving circuit of the type just described is hereinafter referred to as 5Tr/1C driving circuit. The 5Tr/1C driving circuit is shown in FIG. 12. Referring to FIG. 12, the 5Tr/1C driving circuit includes five transistors including an image signal writing transistor $T_{Sig}$, a driving transistor $T_{Drv}$, a light emission control transistor $T_{EL_C}$, a first node initializing transistor $T_{ND1}$ and a second node initializing transistor $T_{ND2}$, and further includes a capacitor element $C_1$. Here, a second one of the source/drain regions of the driving transistor $T_{Drv}$ forms a second node $ND_2$, and the gate electrode of the driving transistor $T_{Drv}$ forms a first node $ND_1$.

It is to be noted that the transistors and the capacitor element are hereinafter described in detail.

For example, each of the transistors is formed from an n-channel type thin film transistor (TFT), and a light emitting portion ELP is provided on an interlayer insulating layer or the like formed in such a manner as to cover the driving circuit. The anode electrode of the light emitting portion ELP is connected to the second one of the source/drain regions of the driving transistor $T_{Drv}$. Meanwhile, a voltage $V_{Cat}$ of, for example, 0 volt is applied to the cathode electrode of the light emitting portion ELP. Reference character $C_{EL}$ denotes parasitic capacitance of the light emitting portion ELP.

Referring to FIG. 13, the organic EL display apparatus includes (1) a scanning circuit 101, (2) an image signal outputting circuit 102, (3) totaling N×M organic electroluminescence devices 10 arranged in a two-dimensional matrix wherein N organic EL devices 10 are arranged in a first direction and M organic EL devices 10 are arranged in a second direction different from the first direction, particularly in a direction perpendicular to the first direction, and each including an organic electroluminescence light emitting portion ELP and a driving circuit for driving the organic electroluminescence light emitting portion ELP, (4) M scanning lines SCL connected to the scanning circuit 101 and extending in the first direction, (5) N data lines DTL connected to the image signal outputting circuit 102 and extending in the second direction, (6) a power supply section 100, (7) a light emission controlling transistor control circuit 103, (8) a first node initializing transistor control circuit 104, and (9) a second node initializing transistor control circuit 105.

It is to be noted that, while, in FIG. 13, 3×3 organic EL devices 10 are shown for the convenience of illustration, this is merely illustrative.

A timing chart illustrating driving of the organic EL devices 10 is schematically illustrated in FIG. 14, and on/off states of the transistors are schematically illustrated in FIGS. 15A to 15D and 16A to 16E. Referring to FIG. 14, within a period $TP(5)_1$, a pre-process for carrying out a threshold voltage cancellation process is executed. In particular, a first node initializing transistor control line $AZ_{ND1}$ and a second node initializing transistor control line $AZ_{ND2}$ are placed into the high level by operation of the first node initializing transistor control circuit 104 and the second node initializing transistor control circuit 105, respectively. Consequently, as seen in FIG. 15B, the first node initializing transistor $T_{ND1}$ and the second node initializing transistor $T_{ND2}$ are placed into an on state so that the potential at the first node $ND_1$ is set to a voltage $V_{Ofs}$, for example, of 0 volt. On the other hand, the potential at the second node $ND_2$ becomes equal to another voltage $V_{SS}$, for example, of −10 volts. Consequently, the potential difference between the gate electrode and the second one of the source/drain regions of the driving transistor $T_{Drv}$ becomes greater than a threshold voltage $V_{th}$, for example, of 3 volts. The driving transistor $T_{Drv}$ remains in an on state.

Then, as seen in FIG. 14, within another period $TP(5)_2$, a threshold voltage cancellation process is carried out. Before completion of the period $TP(5)_1$, the second node initializing transistor control line $AZ_{ND2}$ is placed into the low level to place the second node initializing transistor $T_{ND2}$ into an off state. Then, as seen in FIG. 15D, while the on state of the first node initializing transistor $T_{ND1}$ is maintained, a light emission controlling transistor control line $CL_{EL_C}$ is placed into the high level by operation of the light emission controlling transistor control circuit 103 at a starting timing of the period $TP(5)_2$. Consequently, the light emission control transistor $T_{EL_C}$ is placed into an on state. As a result, the potential at the second node $ND_2$ varies toward the potential of the difference of the threshold voltage $V_{th}$ of the driving transistor $T_{Drv}$ from the potential at the first node $ND_1$. In particular, the potential at the second node $ND_2$ in a floating state rises. Then, when the potential difference between the gate electrode and the second one of the source/drain regions of the driving transistor $T_{Drv}$ reaches the threshold voltage $V_{th}$, then the driving transistor $T_{Drv}$ is placed into an off state. In this state, the potential at the second node $ND_2$ is substantially equal to $V_{Ofs}-V_{th}$. Thereafter, within a period $TP(\mathbf{5})_3$, while the on state of the first node initializing transistor $T_{ND1}$ is maintained, the light emission controlling transistor control line $CL_{EL_C}$ is placed into the low level by operation of the light emission controlling transistor control circuit 103 to place the light emission control transistor $T_{EL_C}$ into an off state. Then, within a period $TP(\mathbf{5})_4$, the first node initializing transistor control line $AZ_{ND1}$ is placed into the low level by operation of the first node initializing transistor control circuit 104 to place the first node initializing transistor $T_{ND1}$ into an off state.

Then, as seen in FIG. 14, within a period $TP(\mathbf{5})_5$, a writing process into the driving transistor $T_{Drv}$ is carried out. In particular, as seen in FIG. 16C, while the off state of the first node initializing transistor $T_{ND1}$, second node initializing transistor $T_{ND2}$ and light emission control transistor $T_{EL_C}$ is maintained, the potential at a data line DTL is set to a voltage corresponding to an image signal, that is, an image signal (driving signal or luminance signal) $V_{Sig}$ for controlling the luminance of the light emitting portion ELP. Then, a scanning line SCL is placed into the high level to place the image signal writing transistor $T_{Sig}$ into an on state. As a result, the potential at the first node $ND_1$ rises to the image signal $V_{Sig}$. Charge based on the variation of the potential at the first node $ND_1$ is distributed to the capacitor element $C_1$, parasitic capacitance $C_{EL}$ of the light emitting portion ELP, and parasitic capacitance between the gate electrode of the driving transistor $T_{Drv}$ and that one of the source/drain regions of the driving transistor $T_{Drv}$ which is adjacent the light emitting portion ELP. Accordingly, if the potential at the first node $ND_1$ varies, then the potential also at the second node $ND_2$ varies. However, as the capacitance value of the parasitic capacitance $C_{EL}$ of the light emitting portion ELP increases, the variation of the potential at the second node $ND_2$ decreases. Then, generally the capacitance value of the parasitic capacitance $C_{EL}$ of the light emitting portion ELP is higher than the capacitance value of the capacitor element $C_1$ and the value of the parasitic capacitance of the driving transistor $T_{Drv}$. Therefore, if it is assumed that the potential at the second node $ND_2$ little varies, then the potential difference $V_{gs}$ between the gate electrode and the second one of the source/drain regions of the driving transistor $T_{Drv}$ has a value defined by the following expression (A):

$$V_{gs} \approx V_{Sig} - (V_{Ofs} - V_{th}) \quad \text{(A)}$$

Thereafter, as seen in FIG. 14, within a period $TP(\mathbf{5})_6$, a mobility correction process of raising the potential at the second one of the source/drain regions of the driving transistor $T_{Drv}$, that is, the potential at the second node $ND_2$, in response to a characteristic of the driving transistor $T_{Drv}$, for example, in response to the magnitude of the mobility μ. In particular, as seen in FIG. 16D, while the on state of the driving transistor $T_{Drv}$ is maintained, the light emission control transistor $T_{EL_C}$ is placed into an on state by operation of the light emission controlling transistor control circuit 103, and then, after predetermined time $t_0$ passes, the image signal writing transistor $T_{Sig}$ is placed into an off state. As a result, where the value of the mobility μ of the driving transistor $T_{Drv}$ is high, the rise amount ΔV, that is, the potential correction amount, of the potential in the second one of the source/drain regions of the driving transistor $T_{Drv}$, is great, but where the value of the mobility μ of the driving transistor $T_{Drv}$ is low, the rise amount ΔV, that is, the potential correction amount, of the potential at the second one of the source/drain regions of the driving transistor $T_{Drv}$, is small. Here, the potential difference $V_{gs}$ between the gate electrode and the second one of the source/drain regions of the driving transistor $T_{Drv}$ is transformed from the expression (A) into an expression (B) given below. It is to be noted that the overall time $t_0$ of the predetermined time, that is, the period $TP(\mathbf{5})_6$, for executing the mobility correction process may be determined in advance as a design value upon designing of the organic EL display apparatus.

$$V_{gs} \approx V_{Sig} - (V_{Ofs} - V_{th}) - \Delta V \quad \text{(B)}$$

By the operation described above, the threshold value cancellation process, writing process and mobility correction process are completed. Then, within a later period $TP(\mathbf{5})_7$, the image signal writing transistor $T_{Sig}$ is placed into an off state, and the first node $ND_1$, that is, as seen in FIG. 16E, the gate electrode of the driving transistor $T_{Drv}$ is placed into floating state. On the other hand, the light emission control transistor $T_{EL_C}$ maintains the on state, and the first one of the source/drain regions of the light emission control transistor $T_{EL_C}$ remains connected to a power supply section of a voltage $V_{CC}$, for example, of 20 volts for controlling light emission of the light emitting portion ELP. Accordingly, as a result of the foregoing, the potential at the second node $ND_2$ rises, and a phenomenon similar to that which occurs with a bootstrap circuit occurs with the gate electrode of the driving transistor $T_{Drv}$ and also the potential at the first node $ND_1$ rises. As a result, the potential difference $V_{gs}$ between the gate electrode and the second one of the source/drain regions of the driving transistor $T_{Drv}$ maintains the value of the expression (B). Further, since current flowing through the light emitting portion ELP is drain current $I_{ds}$ which flows from the drain region to the source region of the driving transistor $T_{Drv}$, if the driving transistor $T_{Drv}$ operates ideally in the saturation region, then the drain current $I_{ds}$ can be represented by the expression (C). The light emitting portion ELP emits light with luminance corresponding to the value of the drain current $I_{ds}$.

$$\begin{aligned} I_{ds} &= k \cdot \mu \cdot (V_{gs} - V_{th})^2 \\ &= k \cdot \mu \cdot (V_{Sig} - V_{Ofs} - \Delta V)^2 \end{aligned} \quad \text{(C)}$$

SUMMARY OF THE INVENTION

As described above, the driving circuit in related art requires three transistors in addition to a driving transistor and an image signal wiring transistor which are required to cause the light emitting portion ELP to emit light. Thus, the configuration of the driving circuit is complicated. From a point of view of achieving facilitation in production, improvement in yield and so forth of an organic EL display apparatus, it is desirable to allow the driving circuit for an organic EL device to have a simple configuration.

Accordingly, it is demanded to provide a driving circuit for an organic electroluminescence light emitting portion, an organic luminescence display apparatus including the driving circuit and a driving method for the organic electroluminescence light emitting portion using the driving circuit, by which a threshold voltage cancellation process for correcting a characteristic dispersion of a driving transistor can be carried out without any trouble with a simple configuration and a good light emitting characteristic of an organic EL device can be anticipated.

According to a first embodiment or a second embodiment of the present invention, an organic electroluminescence display apparatus includes:

(1) a scanning circuit;

(2) an image signal outputting circuit;

(3) totaling N×M organic electroluminescence devices arranged in a two-dimensional matrix wherein N organic electroluminescence devices are arranged in a first direction and M organic electroluminescence devices are arranged in a second direction different from the first direction and each including an organic electroluminescence light emitting portion and a driving circuit for driving the organic electroluminescence light emitting portion;

(4) M scanning lines connected to the scanning circuit and extending in the first direction;

(5) N data lines connected to the image signal outputting circuit and extending in the second direction; and (6) a power supply section.

A driving circuit which composes the organic electroluminescence display apparatus according to the first embodiment of the present invention, a driving circuit for driving an organic electroluminescence light emitting portion according to the first embodiment of the present invention and a driving circuit for use with a driving method for an organic electroluminescence light emitting portion according to the first embodiment of the present invention (any of the driving circuits may sometimes be referred to merely as driving circuit according to the first embodiment) as well as a driving circuit which composes the organic electroluminescence display apparatus according to the second embodiment of the present invention, a driving circuit for driving an organic electroluminescence light emitting portion according to the second embodiment of the present invention and a driving circuit for use with a driving method for an organic electroluminescence light emitting portion according to the second embodiment of the present invention (any of the driving circuits may sometimes be referred to merely as driving circuit according to the second embodiment) include:

(A) a driving transistor of the n channel type having source/drain regions, a channel formation region and a gate electrode;

(B) an image signal writing transistor having source/drain regions, a channel formation region and a gate electrode; and (C) a capacitor element having a pair of electrodes.

The driving transistor is configured such that (A-1) a first one of the source/drain regions thereof is connected to a power supply section; that (A-2) a second one of the source/drain regions thereof is connected to an anode electrode provided on the organic electroluminescence light emitting portion and also to one of the electrodes of the capacitor element in such a manner as to form a second node, and that (A-3) the gate electrode thereof is connected to the second one of the source/drain regions of the image signal writing transistor and also to the other electrode of the capacitor element in such a manner as to form a first node.

The image signal writing transistor is configured such that (B-1) a first one of the source/drain regions thereof is connected to a data line, and (B-2) the gate electrode thereof is connected to a scanning line.

The driving circuit according to the second embodiment of the present invention further includes (D) a first node initializing transistor having source/drain regions, a channel formation region and a gate electrode.

The first node initializing transistor is configured such that (D-1) a first one of the source/drain regions thereof is connected to a first node initializing voltage supply line; that (D-2) a second one of the source/drain regions thereof is connected to the first node; and that (D-3) the gate electrode thereof is connected to a first node initializing transistor control line.

Further, the driving circuit according to the first or second embodiment of the present invention is configured such that a first voltage for supplying current toward the organic electroluminescence light emitting portion through the driving transistor and a second voltage for preventing a potential difference between the second node and a cathode electrode provided on the organic electroluminescence light emitting portion from exceeding a threshold voltage of the organic electroluminescence light emitting portion is selectively applied from the power supply section to the first one of the source/drain regions of the driving transistor, and an LDD (Lightly Doped Drain) structure is formed adjacent the first one of the source/drain regions of the driving transistor.

According to a third embodiment of the present invention, a driving circuit for driving an organic electroluminescence light emitting portion (the driving circuit may sometimes be referred to simply as driving circuit according to the third embodiment of the present invention) includes a driving transistor of the n channel type having source/drain regions, a channel formation region and a gate electrode. A first one of the source/drain regions of the driving transistor is connected to a power supply section while a second one of the source/drain regions of the driving transistor is connected to an anode electrode provided on the organic electroluminescence light emitting portion. A first voltage for supplying current toward the organic electroluminescence light emitting portion through the driving transistor and a second voltage for preventing a potential difference between the second one of the source/drain regions of the driving transistor connected to the anode electrode and a cathode electrode provided on the organic electroluminescence light emitting portion from exceeding a threshold voltage of the organic electroluminescence light emitting portion are selectively applied from the power supply section to the first one of the source/drain regions of the driving transistor, and an LDD structure is formed adjacent the first one of the source/drain regions of the driving transistor.

The driving circuits according to the first, second and third embodiments of the present invention (any of the driving circuits may sometimes be referred to simply as driving circuit according to an embodiment of the present invention) may be configured such that a second LDD structure is formed adjacent the second one of the source/drain regions of the driving transistor and has a length smaller than that of the LDD structure formed adjacent the first one of the source/drain regions of the driving transistor.

According to the first embodiment of the present invention, a driving method for an organic electroluminescence light emitting portion (the method may sometimes be referred to simply as driving method according to the first embodiment of the present invention) uses the driving circuit according to the first embodiment of the present invention and includes the step of:

(a) carrying out a pre-process of applying a first node initializing voltage from the data line to the first node through the image signal writing transistor, which is placed in an on state by a signal from the scanning line, so that the potential difference between the first node and the second node may exceed a threshold voltage of the driving transistor and applying a second voltage from the power supply section to the first one of the source/drain regions of the driving transistor;

(b) carrying out a threshold voltage cancellation process of applying, in a state wherein the first node initializing voltage remains applied from the data line to the first node through the image signal writing transistor which maintains the on state in response to a signal from the scanning line, the first voltage from the power supply section to the first one of the source/drain regions of the driving transistor thereby to cause the potential at the second node to vary toward the potential of the difference of the threshold voltage of the driving transistor from the potential at the first node in a state wherein the potential at the first node is maintained;

(c) carrying out writing process of applying the image signal from the data line to the first node through the image signal writing transistor, which is placed in an on state by a signal from the scanning line; and (d) carrying out a process of placing the image signal writing transistor into an off state in accordance with a signal from the scanning line thereby to place the first node into a floating state and supplying current according to the value of the potential difference between the first node and the second node from the power supply section to the organic electroluminescence light emitting portion through the driving transistor.

According to the second embodiment of the present invention, a driving method for an organic electroluminescence light emitting portion (the method may sometimes be referred to simply as driving method according to the second embodiment of the present invention) uses the driving circuit according to the second embodiment of the present invention and includes the step of:

(a) carrying out a pre-process of applying a first node initializing voltage from the first node initializing voltage supply line to the first node through the first node initializing transistor, which is placed in an on state by a signal from the first node initializing transistor control line, so that the potential difference between the first node and the second node may exceed the threshold voltage of the driving transistor and applying the second voltage from the power supply section to the first one of the source/drain regions of the driving transistor;

(b) carrying out a threshold voltage cancellation process of applying, in a state wherein the first node initializing voltage remains applied from the first node initializing voltage supply line to the first node through the first node initializing transistor which maintains an on state in response to a signal from the first node initializing transistor control line, the first voltage from the power supply section to the first one of the source/drain regions of the driving transistor thereby to cause the potential at the second node to vary toward the potential of the difference of the threshold voltage of the driving transistor from the potential at the first node in a state wherein the potential at the first node is maintained;

(c) carrying out a writing process of applying the image signal from the data line to the first node through the image signal writing transistor, which is placed in an on state by a signal from the scanning line; and (d) carrying out a process of placing the image signal writing transistor into an off state in accordance with a signal from the scanning line thereby to place the first node into a floating state and supplying current according to the value of the potential difference between the first node and the second node from the power supply section to the organic electroluminescence light emitting portion through the driving transistor.

While the driving circuit in related art shown in FIG. 12 is composed of five transistors and one capacitor element, the driving circuits according to an embodiment of the present invention can be configured with the number of transistors reduced. Consequently, facilitation in production, improvement in yield and so forth of an organic electroluminescence display apparatus (which may sometimes be referred to simply as organic EL display apparatus) can be achieved. Further, with the driving method according to the first embodiment of the present invention or the driving method according to the second embodiment of the present invention (any of such driving methods may sometimes be referred to simply as driving method according to an embodiment of the present invention), the threshold voltage cancellation process described above for correcting the characteristic dispersion of the driving transistor or a like process can be carried out without any trouble.

In the driving circuit in related art shown in FIG. 12, the first one of the source/drain regions of the driving transistor functions as the drain region while the second one of the source/drain regions functions as the source region. In the driving method according to the first embodiment of the present invention and the driving method according to the second embodiment of the present invention, when the organic electroluminescence device (which may sometimes be referred to merely as organic EL device) emits light, the first one of the source/drain regions of the driving transistor functions as the drain region while the second one of the source/drain regions functions as the source region. However, in the pre-process or the threshold voltage cancellation process described hereinabove, conversely the first one of the source/drain regions of the driving transistor functions as the source region while the second one of the source/drain regions functions as the drain region. Then, since high current flows through the driving transistor when the organic EL device emits light, the linearity of the saturation characteristic when current flows from the first one of the source/drain regions to the second one of the source/drain regions of the driving transistor is improved. Consequently, the light emitting characteristic of the organic EL device can be improved. In the driving circuit according to an embodiment of the present invention, the LDD structure is formed adjacent the first one of the source/drain regions of the driving transistor. In particular, when the organic EL device emits light, the LDD structure is formed adjacent the drain region of the driving transistor. Accordingly, as hereinafter described with reference to FIG. 1B, the linearity of the saturation characteristic when current flows from the first one of the source/drain regions of the driving transistor to the second one of the source/drain regions of the driving transistor is improved. Consequently, the light emitting characteristic of the organic EL device can be improved.

Further, where the power supply section is connected directly to the driving transistor, when electrostatic noise or the like appears with the power supply section, the driving transistor is likely to be influenced by the same. However, with the driving circuit according to an embodiment of the present invention, since the LDD structure is formed on the driving transistor adjacent the power supply section, the driving circuit has an advantage also in that the LDD structure acts as a protective resistor to the electrostatic noise or the like.

In this instance, the LDD structure can be formed also adjacent the second one of the source/drain regions of the driving transistor. However, from a point of view of varying the potential at the second node in the pre-process or the threshold voltage cancellation process, it is demanded to improve the responsivity of the driving transistor rather than the saturation characteristic. Since the LDD structure acts also as a resistance component, for example, where the LDD structure similar to that formed adjacent the first one of the source/drain regions of the driving transistor is formed adjacent the second one of the source/drain regions of the driving transistor, then the responsivity of the driving transistor in the pre-process or the threshold voltage cancellation process described above deteriorates, and the amount of current flowing through the driving transistor when the organic EL device emits light may possibly decreases. Therefore, in the driving circuit according to an embodiment of the present invention, preferably the second LDD structure is formed adjacent the second one of the source/drain regions of the driving transistor and the length of the second LDD structure is smaller than that of the LDD structure adjacent the first one of the source/drain regions of the driving transistor. In the driving circuit according to an embodiment of the present invention, improvement of the saturation characteristic of the driving transistor upon light emission of the organic EL device and improvement of the responsivity of the driving transistor in the pre-process or the threshold voltage cancellation process described above can be anticipated. It is to be noted that, for the convenience of description, the LDD structure adjacent the first one of the source/drain regions of the driving transistor is sometimes referred to as first LDD structure.

At the step (b) in the driving method according to the first embodiment of the present invention or at the step (b) in the driving method according to the second embodiment of the present invention, the threshold voltage cancellation process of varying the potential at the second node toward the potential of the difference of the threshold voltage of the driving transistor from the potential at the first node is carried out. Qualitatively, the degree by which the potential difference between the first node and the second node, in other words, the potential difference between the gate electrode and the second one of the source/drain regions of the driving transistor, is influenced by the time of the threshold voltage cancellation process. Accordingly, for example, where a sufficiently long period of time is assured for the time of the threshold voltage cancellation process, the potential at the second node reaches the potential of the difference of the threshold voltage of the driving transistor from the potential at the first node. Then, the potential difference between the first node and the second node reaches the threshold voltage of the driving transistor and the driving transistor is placed into an off state. On the other hand, for example, where it may not be avoided to set the time for the threshold voltage cancellation process short, the potential difference between the first node and the second node does not sometimes become higher than the threshold voltage of the driving transistor, and in this instance, the driving transistor is not placed into an off state. In the driving method according to an embodiment of the present invention, as a result of the threshold voltage cancellation process, the driving transistor is not necessarily placed into an off state.

It is to be noted that, in order to allow the potential at the second node to vary toward the potential of the difference of the threshold voltage of the driving transistor from the potential at the first node in a state wherein the potential of the first node is maintained at the step (b) of the driving method according to the first embodiment of the present invention, the voltage of the sum of the potential at the second node at the step (a) described above and the threshold voltage of the driving transistor may be applied to the first one of the source/drain regions of the driving transistor from the power supply section.

The step (c) in the driving method according to the first embodiment of the present invention or the step (c) in the driving method according to the second embodiment of the present invention may be carried out in a state wherein the first voltage for causing the organic electroluminescence light emitting portion to emit light is applied to the first one of the source/drain regions of the driving transistor. In this instance, the mobility correction process is substantially carried out in the writing process.

In the organic electroluminescence display apparatus according to the first embodiment or the second embodiment of the present invention including the various preferred forms described above and the driving circuits according to an embodiment of the present invention, various circuits such as the scanning circuit and the image signal outputting circuit, various wiring lines such as the scanning lines and the data lines, power supply section and the organic electroluminescence light emitting portion (hereinafter referred to sometimes as light emitting portion) may each have any configuration or structure. In particular, the light emitting portion may be composed, for example, of an anode electrode, a hole transport layer, a light emitting layer, an electron transport layer, a cathode electrode and so forth.

The driving circuit according to an embodiment of the present invention may be formed, for example, as a driving circuit composed of two transistors and one capacitor element (2Tr/1C driving circuit) or as another driving circuit composed of three transistors and one capacitor element (3Tr/1C driving circuit). Details of the driving circuit are hereinafter described.

The transistors which compose the driving circuit may be thin film transistors (TFTs) of the n channel type. However, as occasion demands, a thin film transistor of the p channel type may be used, for example, for the image signal writing transistor or the like. The transistors which compose the driving circuit may be of the enhancement type or of the depression type. The first LDD structure or the second LDD structure of the driving transistor may be formed by a widely known method. Meanwhile, the capacitor element may be composed of a first electrode, a second electrode, and a dielectric layer or insulating layer sandwiched between the electrodes. The transistors and the capacitor element which compose the driving circuit are formed in a certain plane, for example, formed on a substrate, and the light emitting portion is formed above the transistors and the capacitor element which compose the driving circuit, for example, with an interlayer insulating layer interposed therebetween. Further, the second one of the source/drain regions of the driving transistor is connected to the anode electrode of the light emitting portion, for example, through a contact hole. It is to be noted that the transistors may be formed on a semiconductor substrate or the like.

The organic EL display apparatus is composed of $(N/3)\times M$ pixels arrayed in a two-dimensional matrix, and each pixel may be formed from three sub pixels, for example, from a red light emitting sub pixel which emits red light, a green light emitting sub pixel which emits green light and a blue light emitting sub pixel which emits blue light. However, the present invention is not limited to this. For example, the organic EL display apparatus may be formed so as to display a monochromatic image.

The organic EL devices which compose the pixels are driven, for example, line-sequentially. The display frame rate in this instance is represented by FR (times/second). In particular, N/3 pixels arrayed in the mth row ($m=1, 2, 3, \ldots, M$), or more particularly, organic EL devices which compose N sub pixels, can be driven at the same time. In other words, in the organic EL devices which form one row, the light emitting/no-light emitting timings are controlled in a unit of a row to which they belong. However, the driving of the organic EL devices is not limited to the line-sequential driving, but the organic EL devices may otherwise be driven dot-sequentially.

It is to be noted that the process of writing an image signal into each of the pixels which form one row in line-sequential driving may be a process of writing an image signal simultaneously into all of the pixels (the process may sometimes be referred to as simultaneous driving process) or another process of writing an image signal sequentially for each pixel (the process may be hereinafter referred to as sequential writing process). Which one of the writing processes should be used may be suitably selected in response to the configuration of the driving circuit.

Although driving or operation regarding organic EL devices positioned in the mth row and the nth column (n=1, 2, 3, . . . , N) is described, such an organic EL device as just mentioned is referred to as (n, m)th organic EL device or (n, m)th sub pixel. Then, various processes such as the threshold voltage cancellation process, writing process and mobility correction process are carried out before a horizontal scanning period for the organic EL devices arrayed in the mth row, that is, before the mth horizontal scanning period, comes to an end. It is to be noted that it is necessary for the writing process and the mobility correction process to be carried out within the mth horizontal scanning period. On the other hand, depending upon the type of the driving circuit, the threshold voltage cancellation process and the pre-process therefor can be carried out prior to the mth horizontal scanning period.

Then, after all of the various processes described above are completed, the light emitting portion of each of the organic EL devices arrayed in the mth row is driven to emit light. It is to be noted that, after all of the various processes described above come to an end, the light emitting portions may be driven immediately to emit light or may otherwise be driven after a predetermined period of time such as, for example, horizontal scanning periods corresponding to a predetermined number of rows elapses. This predetermined period of time may be set suitably in response to the specifications of the organic EL display apparatus, the configuration of the driving circuit and so forth. It is to be noted that it is assumed that, in the following description, the light emitting portions are driven to emit light immediately after the various processes come to an end for the convenience of description. Then, the light emission of the light emitting portions which compose the organic EL devices arrayed in the mth row is continued till a point of time immediately before starting of the horizontal scanning period of the organic EL devices arrayed in the (m+m')th row. Here, "m'" is determined by the design specifications of the organic EL display apparatus. In particular, the light emission of the light emitting portions which compose the organic EL devices arrayed in the mth row of a certain display frame is continued till the (m+m'−1)th horizontal scanning period. On the other hand, the light emitting portions which compose the organic EL devices arrayed in the mth row maintain the no-light emitting state in principle until the writing process and the mobility correction process are completed within the mth horizontal scanning period in the next display frame after the starting timing of the (m+m')th horizontal scanning period. Where the period of the no-light emitting state (hereinafter referred to sometimes as no-light emitting period), afterimage blur involved in active matrix driving is reduced and the moving picture quality can be improved. However, the light emitting state/no-light emitting state of the sub pixels or organic EL devices are not limited to those states described above. Further, the time length of a horizontal scanning period is shorter than (1/FR)× (1/M) second. Where the value of m+m' exceeds M, the excessive horizontal scanning periods are processed in the subsequent display frame.

The term "first one of the source/drain regions" in the two source/drain regions which one transistor has is sometimes used in the meaning of the source/drain region connected to the power supply side. Further, that a transistor is in an on-state signifies a state wherein a channel is formed between the source and drain regions. It does not matter whether or not current flows from the first one of the source/drain regions to the second one of the source/drain regions of the transistor. On the other hand, a transistor is in an off state signifies a state wherein no channel is formed between the source and drain regions. Further, the source/drain regions not only can be made of a conductive substance such as polycrystalline silicon or amorphous silicon which contains impurity but also can be formed from a layer made of a metal, an alloy, conductive particles, a layered structure of them, or an organic material (conductive macromolecules). Further, in various timing charts referred to in the following description, the length of the axis of abscissa, that is, the time length, indicative of each period, is schematic, and does not indicate the ratio in time length between the periods.

While the driving circuit in related art is composed of five transistors and one capacitor element, with the driving circuit according to an embodiment of the present invention, the number of transistors can be reduced. By this, facilitation in production of the organic EL display apparatus, improvement in yield and so forth can be anticipated. Further, by the driving method according to an embodiment of the present invention, the threshold voltage cancellation process for correcting a characteristic dispersion of the driving transistor or a like process can be carried out without any trouble. In the driving circuit according to an embodiment of the present invention, the LDD structure is formed adjacent the first one of the source/drain regions of the driving transistor. Consequently, when the organic EL device emits light, the LDD structure is formed adjacent the drain region of the driving transistor, and the linearity of the saturation characteristic when current flows from the first one of the source/drain regions to the second one of the source/drain regions of the driving transistor is improved and the light emitting characteristic of the organic EL device can be improved. Further, where the LDD structure is formed also adjacent the second one of the source/drain regions of the driving transistor, the second LDD structure having a length smaller than that of the LDD structure provided adjacent the first one of the source/drain regions of the driving transistor is formed adjacent the second one of the source/drain regions of the driving transistor. In the driving circuit according to an embodiment of the present invention, increase of the resistance component by formation of the LDD structure is suppressed, and improvement of the linearity of the saturation characteristic of the driving transistor when the organic EL device emits light and improvement of the responsivity of the driving transistor in the pre-process or the threshold voltage cancellation process can be anticipated.

BRIEF DESCRIPTION OF THE DRAWINGS

FIGS. 5A to 5F are schematic circuit diagrams illustrating on/off states of transistors of the driving circuit of the organic EL device;

FIGS. 10A to 10F are schematic circuit diagrams illustrating on/off states of transistors of the driving circuit of the organic EL device of FIG. 7;

FIGS. 15A to 15D and 16A to 16E are schematic circuit diagrams illustrating on/off states of transistors of the driving circuit of the organic EL device of FIG. 13.

DETAILED DESCRIPTION OF THE PREFERRED EMBODIMENTS

The present invention will hereinafter be described based on working examples with reference to the drawings.

First Working Example

A first working example of the present invention is directed to an organic EL display apparatus according to the first embodiment of the present invention, a driving circuit according to the first and third embodiments of the present invention, and a driving method according to the first embodiment of the present invention.

Figure 1A:
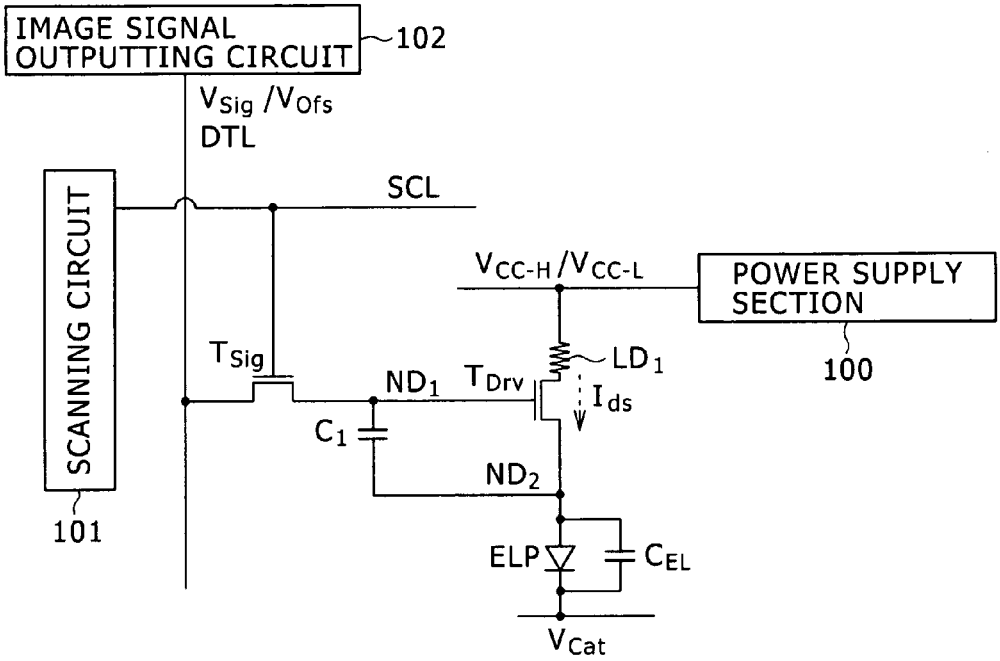
FIG. 1A is an equivalent circuit diagram of a driving circuit formed from two transistors/one capacitor element.
Figure 1B:
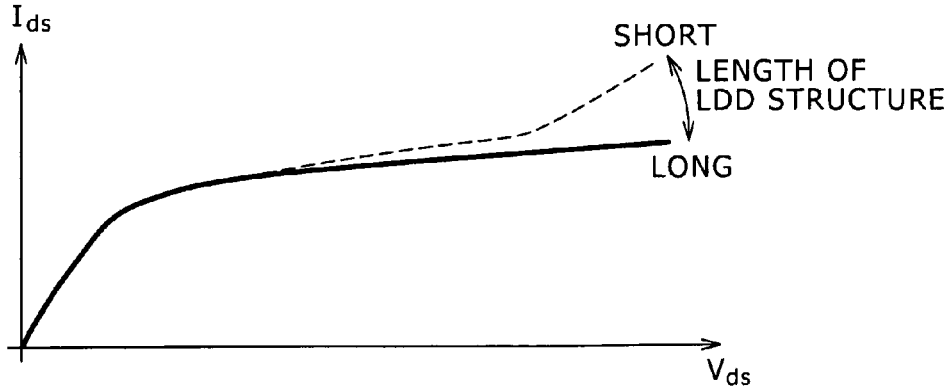
FIG. 1B is a diagram schematically illustrating a relationship between an LDD structure and drain current of a driving transistor which is a component of the driving circuit.
Figure 2:
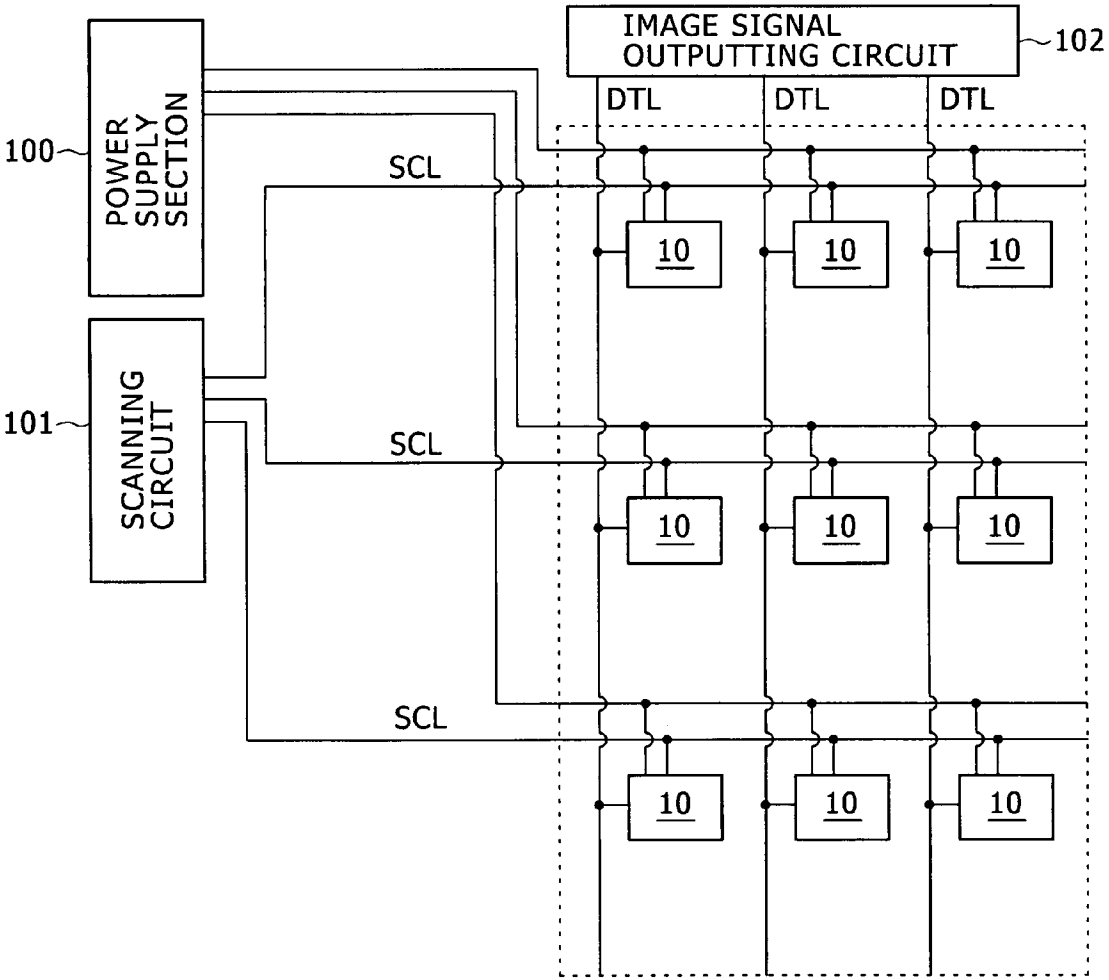
FIG. 2 is a schematic view showing a concept of an organic EL display apparatus.
Figure 3A:
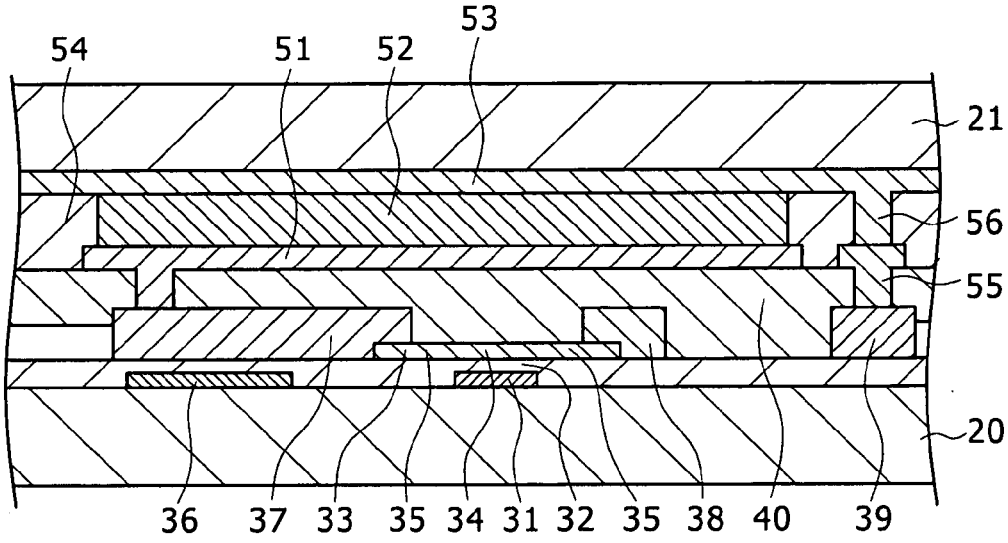
FIG. 3A is a schematic sectional view of part of an organic EL device.
Figure 3B:
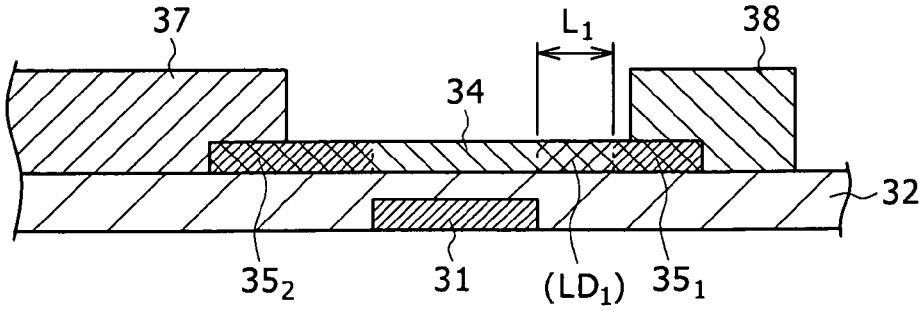
FIG. 3B is a schematic sectional view of the organic EL device in the proximity of a driving transistor of the organic EL device.
Figure 4:
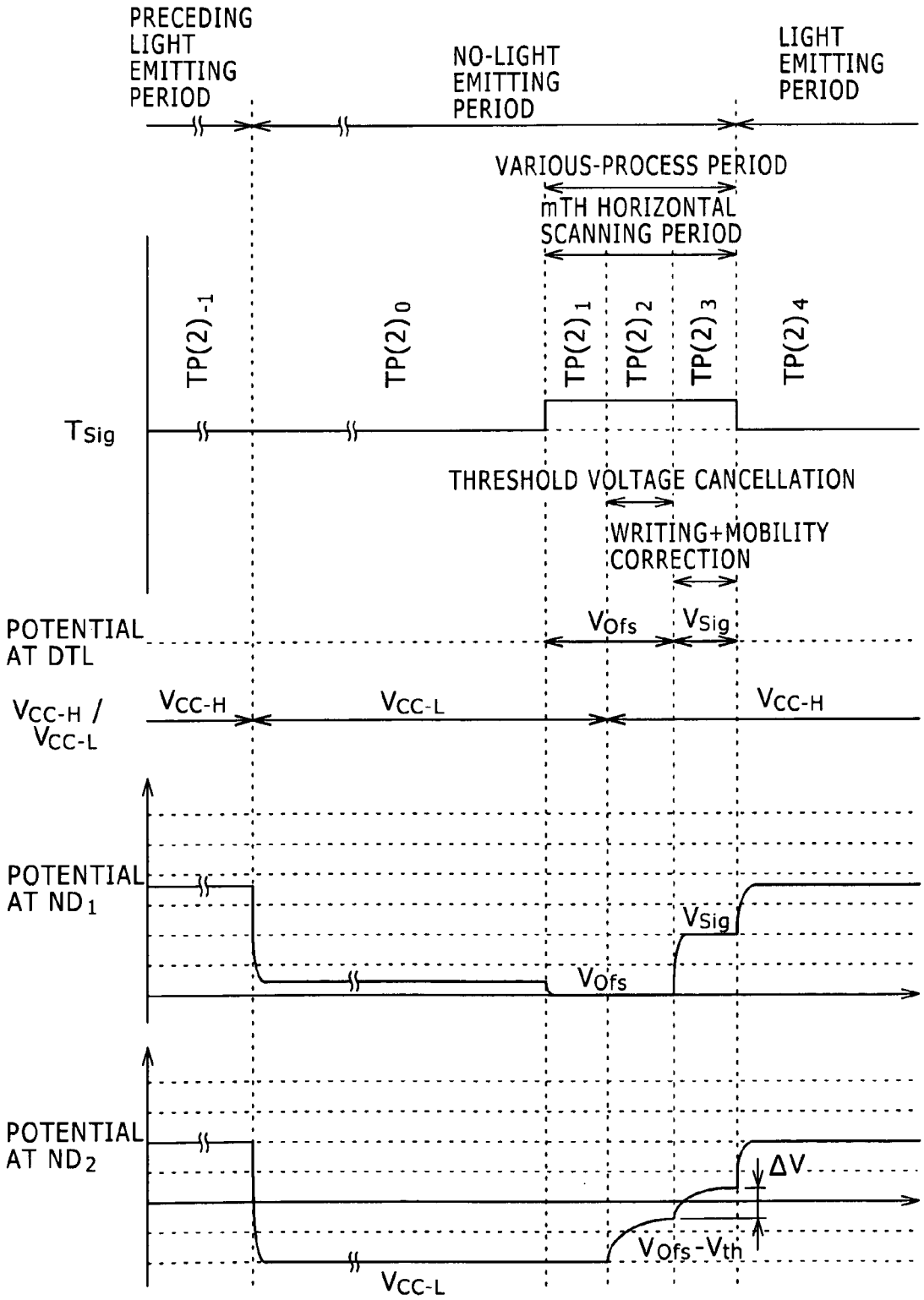
FIG. 4 is a timing chart illustrating driving of the organic EL device.

An equivalent circuit diagram of a driving circuit of the first working example is shown in FIG. 1A. A relationship between an LDD (Lightly Doped Drain) structure and drain current of a driving transistor which is a component of the driving circuit is schematically shown in FIG. 1B. A concept of an organic EL display apparatus of the first working example is shown in FIG. 2. A schematic sectional view of part of an organic EL device 10 is shown in FIG. 3A, and a schematic sectional view of the organic EL device 10 in the proximity of a driving transistor of the organic EL device 10 is shown in FIG. 3B. A timing chart illustrating driving of the organic EL device 10 is schematically illustrated in FIG. 4. On/off states of transistors of the driving circuit of the organic EL device 10 are schematically shown in FIGS. 5A to 5F.

First, the organic EL display apparatus and the driving circuit of the first working example are described. The organic EL display apparatus of the first working example includes, as seen in FIG. 2, (1) a scanning circuit 101, (2) an image signal outputting circuit 102, (3) totaling N×M organic EL devices 10 arrayed in a two-dimensional matrix wherein N organic EL devices 10 are arranged in a first direction, in the first working example, in a horizontal direction, and M organic EL devices 10 are arranged in a second direction different from the first direction, particularly in a direction perpendicular to the first direction, in the first working example, in the vertical direction, (4) M scanning lines SCL connected to the scanning circuit 101 and extending in the first direction, (5) N data lines DTL connected to the image signal outputting circuit 102 and extending in the second direction, and (6) a power supply section 100.

This similarly applies also to the other working examples hereinafter described.

It is to be noted that, while 3×3 organic EL devices 10 are shown in FIG. 2 and also in FIG. 8 hereinafter described, the arrangement is merely illustrative to the end.

Each of the organic EL devices 10 includes a driving circuit and a light emitting portion ELP. The light emitting portion ELP has, for example, a known configuration and structure including an anode electrode, a hole transport layer, a light emitting layer, an electron transport layer and a cathode electrode. The scanning circuit 101, image signal outputting circuit 102, scanning lines SCL, data lines DTL and power supply section 100 may have a known configuration and structure. This similarly applies also to the other working examples hereinafter described. Also a first node initializing transistor control circuit 104 hereinafter described may have a known configuration and structure.

The driving circuit of the first working example shown in FIG. 1 is for driving the light emitting portion ELP and includes a driving transistor $T_{Drv}$ of the n-channel type which includes source/drain regions, a channel formation region and a gate electrode. In the driving transistor $T_{Drv}$, a first one of the source/drain regions is connected to the power supply section 100 while a second one of the source/drain regions is connected to the anode electrode provided on the light emitting portion ELP. This similarly applies also to the other working examples hereinafter described.

To the first one of the source/drain regions of the driving transistor $T_{Drv}$, a first voltage $V_{CC-H}$ and a second voltage $V_{CC-L}$ are selectively applied from the power supply section 100. The first voltage $V_{CC-H}$ is for causing current to flow toward the light emitting portion ELP through the driving transistor $T_{Drv}$ and is, for example, 20 volts. The second voltage $V_{CC-L}$ is for suppressing the potential difference between that one of the source/drain regions of the driving transistor $T_{Drv}$ which is connected to the anode electrode described above and the cathode electrode provided on the light emitting portion ELP so as not to exceed a threshold voltage of the light emitting portion ELP. The second voltage $V_{CC-L}$ is, for example, −10 volts. This similarly applies also to the other working examples hereinafter described. It is to be noted that the threshold voltage of the light emitting portion ELP will be hereinafter described.

More detailed description is given below. The driving circuit of the first working example includes two transistors and one capacitor element $C_1$. The circuit of the type just described is hereinafter referred to sometimes as 2Tr/1C driving circuit. In particular, the driving circuit of the first working example includes (A) a driving transistor $T_{Drv}$, (B) an image signal writing transistor $T_{Sig}$, and (C) a capacitor element $C_1$ having a pair of electrodes.

The driving transistor $T_{Drv}$ and the image signal writing transistor $T_{Sig}$ are formed from an n-channel type TFT including source/drain regions, a channel formation region and a gate electrode. This similarly applies also to the other working examples hereinafter described. It is to be noted that the image signal writing transistor $T_{Sig}$ may be formed from a p-channel type TFT.

The driving transistor $T_{Drv}$ is configured such that (A-1) a first one of the source/drain regions is connected to the power supply section 100, (A-2) a second one of the source/drain regions is connected to the anode electrode provided on the light emitting portion ELP and also to one of the electrodes of the capacitor element $C_1$ in such a manner as to form a second node $ND_2$, and (A-3) the gate electrode is connected to the second one of the source/drain regions of the image signal writing transistor $T_{Sig}$ and also to the other electrode of the capacitor element $C_1$ in such a manner as to form a first node $ND_1$. This similarly applies also to the other working examples hereinafter described.

As described hereinabove, to the first one of the source/drain regions of the driving transistor $T_{Drv}$, the first voltage $V_{CC-H}$ and the second voltage $V_{CC-L}$ are selectively applied from the power supply section 100. The first voltage $V_{CC-H}$ is a voltage for causing current to flow toward the light emitting portion ELP through the driving transistor $T_{Drv}$. The second voltage $V_{CC-L}$ is a voltage for suppressing the potential difference between the second node $ND_2$ and the cathode electrode provided on the light emitting portion ELP so as not to exceed the threshold voltage of the light emitting portion ELP. This similarly applies also to the other working examples hereinafter described.

If the driving transistor $T_{Drv}$ operates ideally in a saturation region to supply current to the light emitting portion ELP of an organic EL device 10, then the driving transistor $T_{Drv}$ is driven so as to supply drain current $I_{ds}$ in accordance with the following expression (1). In a light emitting state of the organic EL device 10, the first one of the source/drain regions of the driving transistor $T_{Drv}$ functions as the drain region while the second one of the source/drain regions functions as the source region. This similarly applies also to the other working examples hereinafter described.

$$I_{ds}=k\cdot\mu\cdot(V_{gs}-V_{th})^2 \quad (1)$$

where μ is the effective mobility, $V_{gs}$ the potential difference between the gate electrode and that one of the source/electrode regions which functions as the source region, Vth the threshold voltage, and k is a constant given by $k\equiv(1/2)\cdot(W/L)\cdot C_{OX}$, where W is the channel width of the driving transistor $T_{Drv}$, L the channel length of the driving transistor $T_{Drv}$, and $C_{OX}$ a value given by (relative dielectric constant of the gate insulating layer)×(dielectric constant of the vacuum)/(thickness of the gate insulating layer).

When the drain current $I_{ds}$ flows through the light emitting portion ELP of the organic EL device 10, the light emitting portion ELP of the organic EL device 10 emits light. The light emitting state or luminance of the light emitting portion ELP of the organic EL device 10 is controlled by the magnitude of the value of the drain current $I_{ds}$. This similarly applies also to the other working examples hereinafter described.

The image signal writing transistor $T_{Sig}$ is configured such that (B-1) the first one of the source/drain regions is connected to a data line DTL, and (B-2) the gate electrode is connected to a scanning line SCL. This similarly applies also to the other working examples hereinafter described.

The first one of the source/drain regions of the image signal writing transistor $T_{Sig}$ is connected to a data line DTL as described above. Thus, an image signal $V_{Sig}$ for controlling the luminance of the light emitting portion ELP or a first node initializing voltage $V_{Ofs}$ hereinafter described is supplied from the image signal outputting circuit 102 to the first one of the source/drain regions through the data line DTL. It is to be noted that various other signals or voltages such as a signal for precharge driving and various reference voltages other than the image signal $V_{Sig}$ and the first node initializing voltage $V_{Ofs}$ may be supplied to the first one of the source/drain regions through the data line DTL. The on/off operation of the image signal writing transistor $T_{Sig}$ is controlled by a scanning line SCL connected to the gate electrode of the image signal writing transistor $T_{Sig}$.

The anode electrode of the light emitting portion ELP is connected to the second one of the source/drain regions of the driving transistor $T_{Drv}$ as described hereinabove. Meanwhile, a voltage $V_{Cat}$ is applied to the cathode electrode of the light emitting portion ELP. The parasitic capacitance of the light emitting portion ELP is represented by reference character $C_{EL}$. Meanwhile, the threshold voltage required for emission of light of the light emitting portion ELP is represented by $V_{th-EL}$. In other words, if a voltage higher than the threshold voltage $V_{th-EL}$ is applied between the anode electrode and the cathode electrode of the light emitting portion ELP, then the light emitting portion ELP emits light. This similarly applies also to the other working examples hereinafter described.

Referring back to FIG. 1, an LDD structure, that is, a first LDD structure, represented by reference character $LD_1$ is formed in the first one of the source/drain regions of the driving transistor $T_{Drv}$. This similarly applies also to the other working examples hereinafter described.

While the driving method according to the first working example is hereinafter described, in order to cause the light emitting portion ELP to emit light, the first voltage $V_{CC-H}$ is applied from the power supply section 100 to the first one of the source/drain regions of the driving transistor $T_{Drv}$. In this instance, the first one of the source/drain regions of the driving transistor $T_{Drv}$ functions as the drain region while the second one of the source/drain regions functions as the source region. Then, the LDD structure $LD_1$ is formed for the first one of the source/drain regions of the driving transistor $T_{Drv}$. In particular, when the organic EL device emits light, the LDD structure is formed on the drain region side of the driving transistor. Accordingly, the linearity of the drain current $I_{ds}$ in the saturation region described hereinabove is improved, and the light emission characteristic of the organic EL device 10 can be improved. Further, increase of a resistance component by formation of the LDD structure is suppressed, and improvement of the linearity of the saturation characteristic of the driving transistor $T_{Drv}$ upon emission of light of the organic EL device 10 and improvement of the responsivity of the driving transistor $T_{Drv}$ in a pre-process and a threshold voltage cancellation process hereinafter described can be achieved. It is to be noted that the linearity is improved more as the length of the LDD structure, or more particularly, a length $L_1$ hereinafter described with reference to FIG. 2, increases. The length $L_1$ of the LDD structure may be set suitably in accordance with its design. This similarly applies also to the other working examples hereinafter described.

Now, the structure of the transistors and the capacitor element $C_1$ which compose the driving circuit according to the first working example including the LDD structure $LD_1$ shown in FIG. 1A is described in detail with reference to FIGS. 3A and 3B.

Referring first to FIG. 3A, the transistors and the capacitor element $C_1$ which compose the driving circuit according to the first working example are formed on a substrate 20, and the light emitting portion ELP is formed above the transistors and the capacitor element $C_1$ which compose the driving circuit, for example, with an interlayer insulating layer 40 interposed therebetween. Meanwhile, the second one of the source/drain regions of the driving transistor $T_{Drv}$ is connected to the anode electrode of the light emitting portion ELP through a contact hole. It is to be noted that, in FIG. 3A, only the driving transistor $T_{Drv}$ is shown. The other transistors than the driving transistor $T_{Drv}$ are hidden and cannot be observed.

As described above, the driving transistor $T_{Drv}$ is formed from an n-channel transistor. More particularly, as seen in FIGS. 3A and 3B, the driving transistor $T_{Drv}$ includes a gate electrode 31, a gate insulating layer 32, a semiconductor layer 33, a channel formation region 34 formed from a portion of the semiconductor layer 33 corresponding to the gate electrode 31, a first one 351 and a second one $\mathbf{35}_2$ of the source/drain regions provided on the semiconductor layer 33, and an LDD structure $LD_1$ formed between the channel formation region 34 and the first one $\mathbf{35}_1$ of the source/drain regions. It is to be noted, in FIG. 3A, the first one $\mathbf{35}_1$ of the source/drain regions and the LDD structure $LD_1$ are denoted merely by a reference numeral 35 for the convenience of illustration. Similarly, also the second one $\mathbf{35}_2$ of the source/drain regions is denoted merely by the reference numeral 35.

Meanwhile, the capacitor element $C_1$ includes a second electrode 36, a dielectric layer formed from an extension of the gate insulating layer 32, and a first electrode 37 which corresponds to the second node $ND_2$. The gate electrode 31, part of the gate insulating layer 32 and the second electrode 36 which form the capacitor element $C_1$ are formed on the substrate 20. The first one $\mathbf{35}_1$ of the source/drain regions of the driving transistor $T_{Drv}$ is connected to a wiring line 38 while the second one $\mathbf{35}_2$ of the source/drain regions is connected to the first electrode 37. The driving transistor $T_{Drv}$, capacitor element $C_1$ and so forth are covered with an interlayer insulating layer 40, and a light emitting portion ELP composed of an anode electrode 51, a hole transport layer, a light emitting layer, an electron transport layer and a cathode electrode 53 is provided on the interlayer insulating layer 40. It is to be noted that, in FIG. 3A, the hole transport layer, light emitting layer and electron transport layer are represented by one layer 52. A second interlayer insulating layer 54 is provided at a portion of the interlayer insulating layer 40 at which the light emitting portion ELP is not provided, and a transparent substrate 21 is disposed on the second interlayer insulating layer 54 and the cathode electrode 53 such that the light emitted from the light emitting layer is emitted to the outside through the substrate 21. It is to be noted that the first electrode 37 and the anode electrode 51 are connected to each other through a contact hole formed in the interlayer insulating layer 40. Further, the cathode electrode 53 is connected to a wiring line 39 provided on the extension of the gate insulating layer 32 through contact holes 56 and 55 formed in the second interlayer insulating layer 54 and the interlayer insulating layer 40, respectively.

Figure 12:
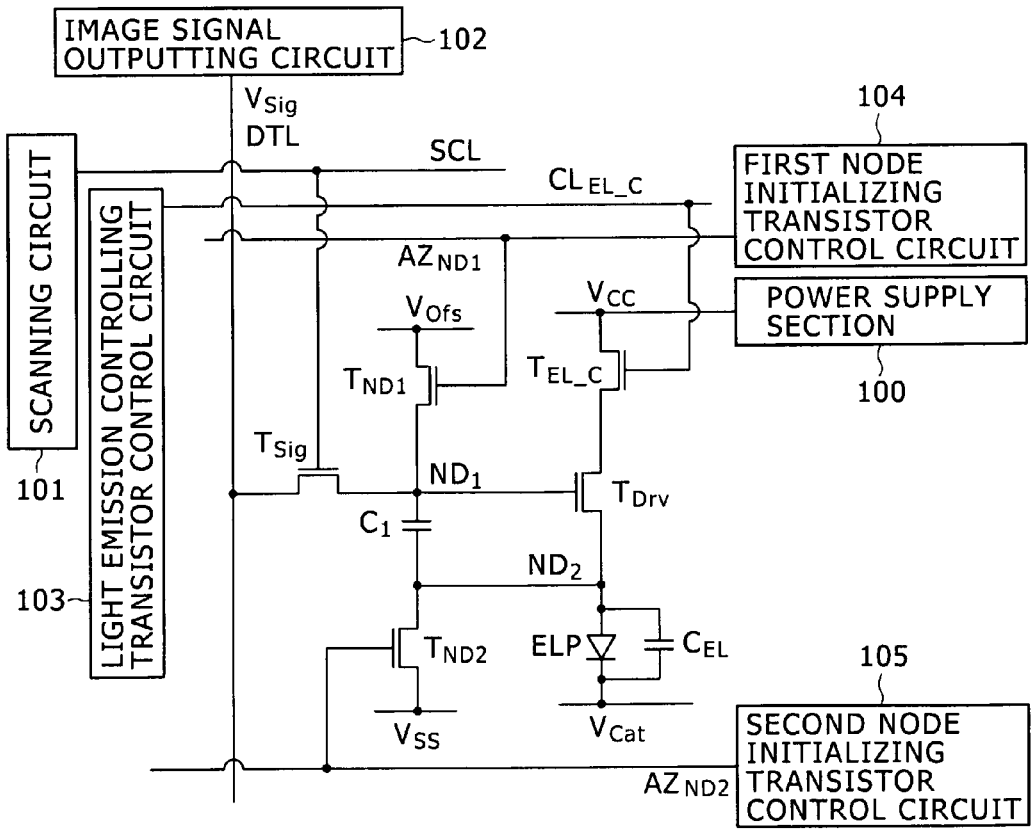
FIG. 12 is an equivalent circuit of a driving circuit formed from 5-transistors/one capacitor element.
Figure 13:
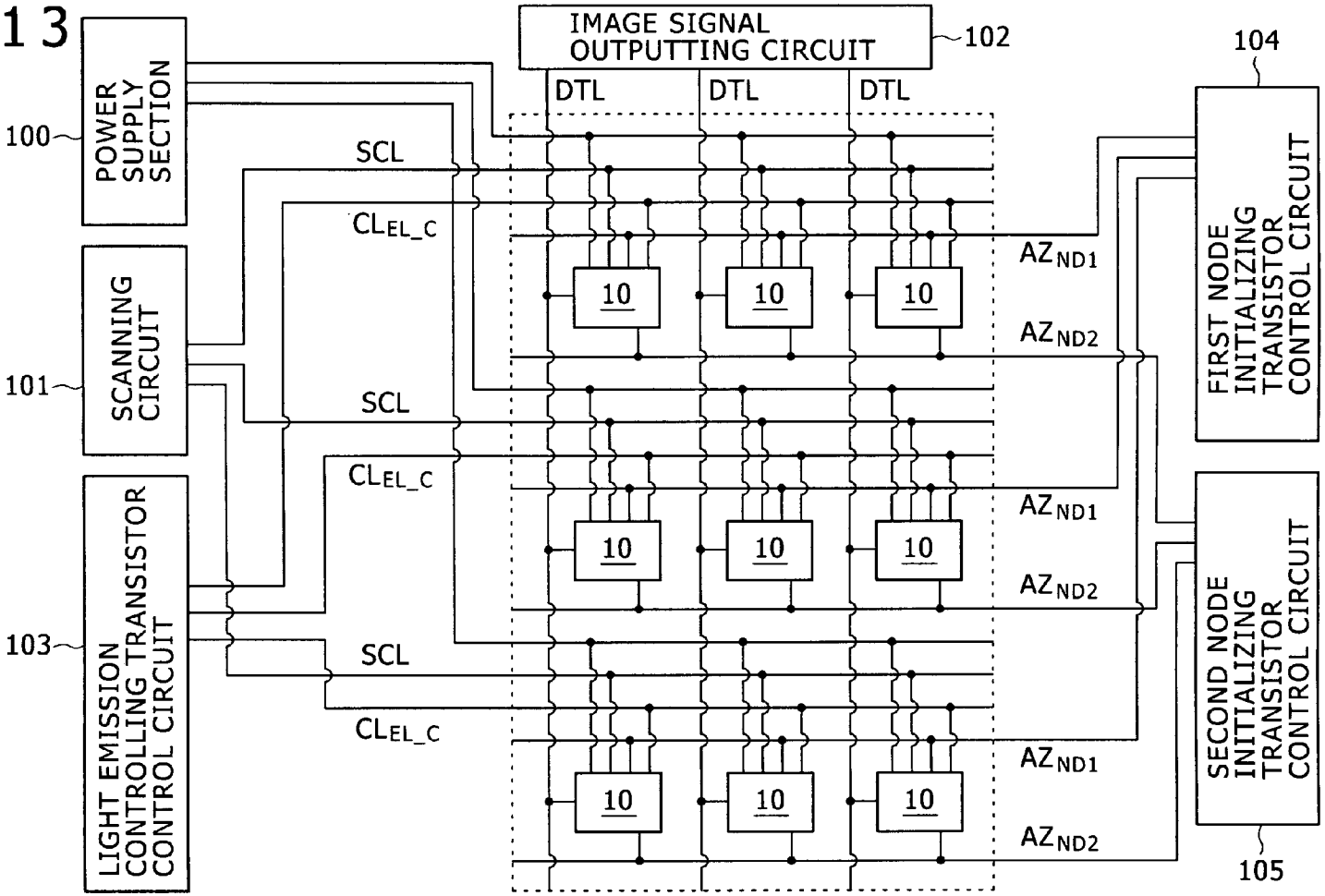
FIG. 13 is a block diagram of a further organic EL display apparatus.

It is to be noted that the capacitor element $C_1$ of the 5Tr/1C driving circuit in related art described hereinabove with reference to FIG. 12 has a configuration similar to that described above. Also the transistors which compose the 5Tr/1C driving circuit in related art are formed from a gate electrode, a gate insulating layer and a semiconductor layer basically similarly to that described above.

The configuration of the organic EL display apparatus and the driving circuit for driving the light emitting portion ELP according to the first working example is described, and also the configuration of the 5Tr/1C driving circuit in related art is described. While the driving circuit in related art includes five transistors and one capacitor element, the number of transistors can be reduced in the driving circuit of the first working example. Consequently, facilitation in production, improvement in yield and so forth of an organic EL display apparatus can be achieved.

Now, the driving method for the light emitting portion ELP using the driving circuit described above is described. It is to be noted that, although the following description proceeds under the assumption that a light emitting state starts immediately after all of the various processes including the threshold value cancellation process, writing process and mobility correction process are completed as described above, starting of a light emitting state is not limited to this.

It is to be noted that, in the following description including the description of the other working examples, various values given below are used as voltage or potential values. However, the values are merely for description to the end, and the voltage or potential values are not limited to the specific values.

$V_{Sig}$: image signal for controlling the luminance of the light emitting portion ELP
. . . 0 to 10 volts $V_{CC\text{-}H}$: first voltage for supplying current to the light emitting portion ELP
. . . 20 volts $V_{CC\text{-}L}$: second voltage for suppressing the potential difference between the second node $ND_2$ and the cathode electrode provided in the light emitting portion ELP so as not to exceed the threshold voltage $V_{th\text{-}EL}$
. . . 10 volts $V_{Ofs}$: voltage for initializing the potential at the gate electrode of the driving transistor $T_{Drv}$ (potential at the first node $ND_1$)
. . . 0 volt $V_{th}$: threshold voltage of the driving transistor $T_{Drv}$
. . . 3 volts $V_{Cat}$: voltage applied to the cathode electrode of the light emitting portion ELP
. . . 0 volt $V_{th\text{-}EL}$: threshold voltage of the light emitting portion ELP
. . . 3 volts In the driving method of the first working example, (a) a pre-process of applying the first node initializing voltage $V_{Ofs}$ from the data line DTL to the first node $ND_1$ through the image signal writing transistor $T_{Sig}$, which is placed in an on state in response to a signal from the scanning line SCL, so that the potential difference between the first node $ND_1$ and the second node $ND_2$ may exceed the threshold voltage $V_{th}$ of the driving transistor $T_{Drv}$ and applying the second voltage $V_{CC\text{-}L}$ to the first one of the source/drain regions of the driving transistor $T_{Drv}$ from the power supply section 100 is carried out.

More particularly, in the driving method of the first working example, at the step (a) described above, the first node initializing voltage $V_{Ofs}$ is applied from the data line DTL to the first node $ND_1$ by operation of the image signal outputting circuit 102 through the image signal writing transistor $T_{Sig}$ which is placed in an on state in response to a signal from the scanning line SCL by operation of the scanning circuit 101.

In the driving method of the first working example, (b) a threshold voltage canceling process of applying, in a state wherein the first node initializing voltage $V_{Ofs}$ is applied from the data line DTL to the first node $ND_1$ through the image signal writing transistor $T_{Sig}$ which maintains an on state in response to a signal from the scanning line SCL, the first voltage $V_{CC\text{-}H}$ from the power supply section 100 to the first one of the source/drain regions of the driving transistor $T_{Drv}$ to maintain the potential at the first node $ND_1$ and varying the potential at the second node $ND_2$ from the potential at the first node $ND_1$ toward a potential of the difference between the potential at the first node $ND_1$ and the threshold voltage $V_{th}$ of the driving transistor $T_{Drv}$ is carried out subsequently.

In the driving method of the first working example, (c) a writing process of applying the image signal $V_{Sig}$ from the data line DTL to the first node $ND_1$ through the image signal writing transistor $T_{Sig}$ which is placed in an on state in response to a signal from the scanning line SCL.

More particularly, in the driving method of the first working example, at the step (c) described above, the image signal $V_{Sig}$ is applied from the data line DTL to the first node $ND_1$ by operation of the image signal outputting circuit 102 through the image signal writing transistor $T_{Sig}$ which is placed in an on state in response to a signal from the scanning line SCL by operation of the scanning circuit 101.

In the driving method of the first working example, (d) the image signal writing transistor $T_{Sig}$ is subsequently placed into an off state in response to a signal from the scanning line SCL to place the first node $ND_1$ into a floating state so that current corresponding to the value of the potential difference between the first node $ND_1$ and the second node $ND_2$ is supplied from the power supply section 100 to the light emitting portion ELP through the driving transistor $T_{Drv}$ to drive the light emitting portion ELP.

More particularly, in the driving method of the first working example, at the step (d) described above, the image signal writing transistor $T_{Sig}$ is placed into an off state in response to a signal from the scanning line SCL by operation of the scanning circuit 101 to place the first node $ND_1$ into a floating state. Then, current corresponding to the value of the potential difference between the first node $ND_1$ and the second node $ND_2$ is supplied from the power supply section 100 to the light emitting portion ELP to drive the light emitting portion ELP.

It is to be noted that, in the first working example, a mobility correction process is carried out substantially simultaneously with the writing process at the step (c) described above. Details are hereinafter described.

The steps (a), (b), (c) and (d) are described below with reference to FIGS. 4 and 5A to 5F.

Period $TP(\mathbf{2})_{-1}$ (Refer to FIGS. 4 and 5A)

This Period $TP(\mathbf{2})_{-1}$ is a period within which, for example, the (n, m)th organic EL device 10 is in a light emitting state after various processes in the preceding operation cycle are completed as operation in the preceding display frame. In particular, drain current $I'_{ds}$ according to the expression (5) given hereinbelow flows through the light emitting portion ELP of the organic EL device 10 which forms the (n, m)th sub pixel, and the luminance of the organic EL device 10 which forms the (n, m)th sub pixel has a value corresponding to the drain current $I'_{ds}$. Here, the image signal writing transistor $T_{Sig}$ is in an off state, and the driving transistor $T_{Drv}$ is in an on state. The light emitting state of the (n, m)th organic EL device 10 continues till a point of time immediately prior to starting of a horizontal scanning of the organic EL devices 10 arrayed on the (m+m')th row.

Figure 14:
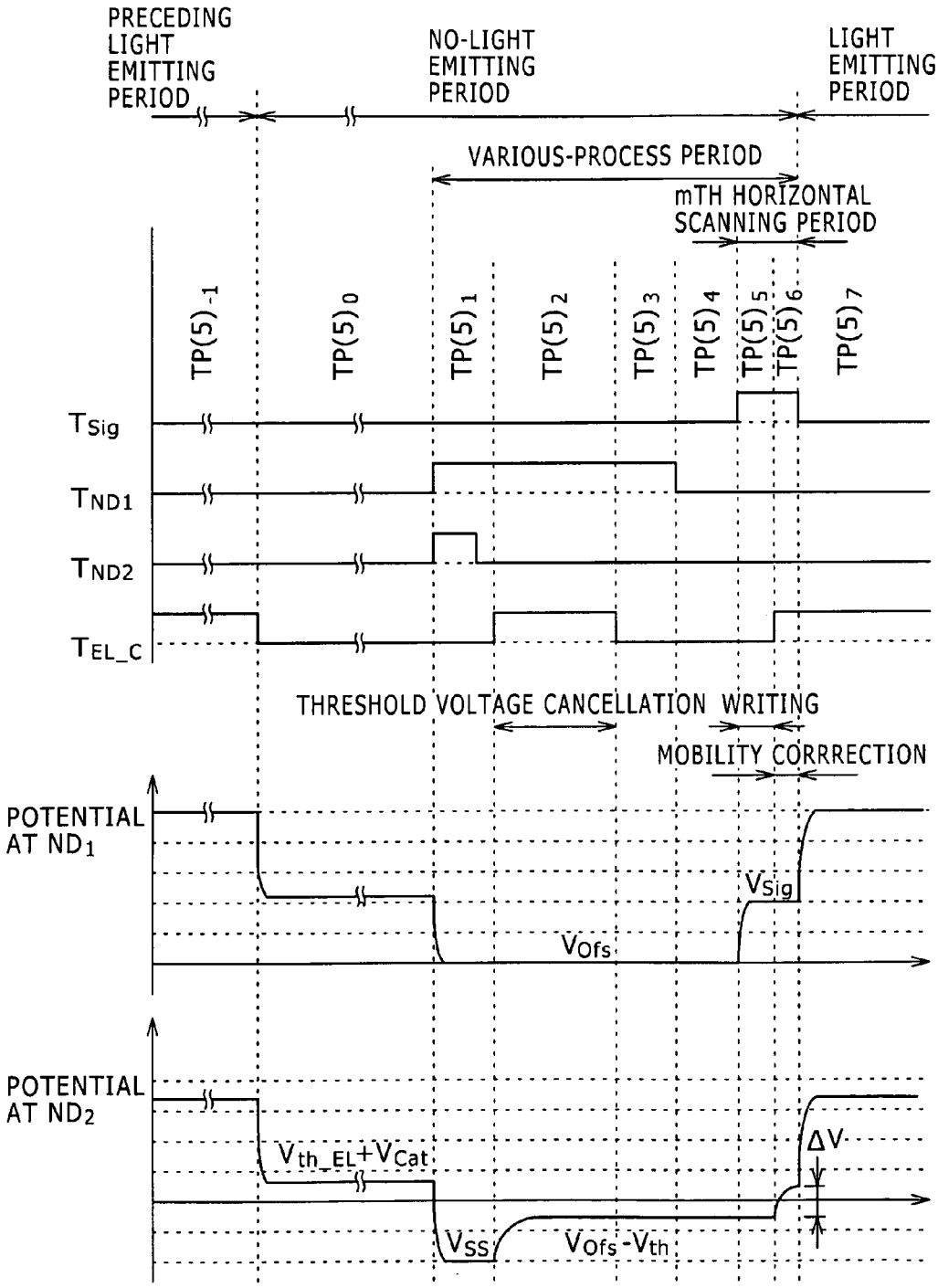
FIG. 14 is a timing chart illustrating driving of the organic EL device of FIG. 13.

It is to be noted that, also in the period $TP(\mathbf{5})_{-1}$, illustrated in FIG. 14 referred to in the description of the related art, operation substantially similar to that in the period $TP(\mathbf{2})_{-1}$, is carried out.

The periods from the period $TP(\mathbf{2})_0$ to the period $TP(\mathbf{2})_2$ illustrated in FIG. 4 are an operation period from a point of time immediately after the light emitting state after the various processes in the preceding cycle are completed to another point of time immediate before a next writing process is carried out. Then, in the periods from the period $TP(\mathbf{2})_0$ to the period $TP(\mathbf{2})_2$, the (n, m)th organic EL device remains in a no-light emitting state in principle. It is to noted that, for the convenience of description, it is assumed that the starting timing of the period $TP(\mathbf{2})_1$ and the ending timing of the period $TP(\mathbf{2})_3$ coincide with the starting timing and the ending timing of the mth horizontal scanning period, respectively.

In the following, the periods from the period $TP(\mathbf{2})_0$ to the period $TP(\mathbf{2})_2$ are described. It is to be noted that the length of the periods from the period $TP(\mathbf{2})_1$ to the period $TP(\mathbf{2})_3$ may be set suitably in accordance with the design of the organic EL display apparatus.

Period $TP(\mathbf{2})_0$ (Refer to FIG. 5B)

Operation within the period $TP(\mathbf{2})_0$ relates, for example, to the preceding display frame to the current display frame. In particular, the period $TP(\mathbf{2})_0$ is a period from the (m+m')th horizontal scanning period in the preceding display frame to the (m−1)th horizontal period of the current display frame. Then, within the period $TP(\mathbf{2})_0$, the (n, m)th organic EL device is in a no-light emitting state in principle. At a point of time of transition from the period $TP(\mathbf{2})_{-1}$ to the period $TP(\mathbf{2})_0$, the voltage supplied from the power supply section 100 is changed over from the first voltage $V_{CC-H}$ to the second voltage $V_{CC-L}$. As a result, the potential at the second node $ND_2$, that is, at the second one of the source/drain regions of the driving transistor $T_{Drv}$ or the anode electrode of the light emitting portion ELP, drops to the second voltage $V_{CC-L}$, and the light emitting portion ELP is placed into a no-light emitting state. Further, also the potential at the first node $ND_1$ in a floating state, that is, at the gate of the driving transistor $T_{Drv}$, drops in such a manner as to follow the potential drop of the second node $ND_2$.

It is to be noted that the period $TP(\mathbf{5})_0$ illustrated in FIG. 14 referred to in the description of the related art corresponds to the period $TP(\mathbf{2})_0$ described hereinabove. In FIG. 14, at a point of time of transition from the period $TP(\mathbf{5})_{-1}$ to the period $TP(\mathbf{5})_0$, the light emission control transistor $T_{EL_C}$ is placed into an off state. Therefore, the potential at the second node $ND_2$, that is, at the source region of the driving transistor $T_{Drv}$ or the anode electrode of the light emitting portion ELP, drops to $(V_{th-EL}+V_{Cat})$, and the light emitting portion ELP is placed into a no-light emitting state. Further, also the potential at the first node $ND_1$ in a floating state, that is, at the gate electrode of the driving transistor $T_{Drv}$, drops in such a manner as to follow the potential drove at the second node $ND_2$.

Period $TP(\mathbf{2})_1$ (Refer to FIGS. 4 and 5C)

Within this period, the step (a) described hereinabove, that is, the pre-process described above, is carried out.

A horizontal scanning period for the mth row of the current display frame is started at the starting timing of the period $TP(\mathbf{2})_1$. The first node initializing voltage $V_{Ofs}$ is applied to the data line DTL by operation of the image signal outputting circuit 102 from the starting timing of the period $TP(\mathbf{2})_1$ to the ending timing of the period $TP(\mathbf{2})_2$ hereinafter described. The state wherein the second voltage $V_{CC-L}$ is applied from the power supply section 100 to the first one of the source/drain regions of the driving transistor $T_{Drv}$ is maintained, and at the starting timing of the period $TP(\mathbf{2})_1$, the scanning line SCL is placed into the high level by operation of the scanning circuit 101. Then, the first node initializing voltage $V_{Ofs}$ is applied from the data line DTL to the first node $ND_1$ through the image signal writing transistor $T_{Sig}$ which is placed in an on state in response to a signal from the scanning line SCL.

As a result, the potential at the first node $ND_1$ becomes equal to the first node initializing voltage $V_{Ofs}$ which is 0 volt. On the other hand, the potential at the second node $ND_2$ is equal to the second voltage $V_{CC-L}$ which is −10 volts. Since the potential difference between the first node $ND_1$ and the second node $ND_2$ is 10 volts and the threshold voltage $V_{th}$ of the driving transistor $T_{Drv}$ is 3 volts, the driving transistor $T_{Drv}$ is in an on state. It is to be noted that the potential difference between the second node $ND_2$ and the cathode electrode provided on the light emitting portion ELP is −10 volts and does not exceed the threshold voltage $V_{th-EL}$ of the light emitting portion ELP.

Period $TP(2)_2$ (Refer to FIGS. 4 and 5D)

Within this period, the step (b) described hereinabove, that is, the threshold voltage cancellation process described hereinabove, is carried out.

Period $TP(2)_2$ (Refer to FIG. 5D)

In particular, in a state wherein the first node initializing voltage $V_{Ofs}$ is applied from the data line DTL to the first node $ND_1$ through the image signal writing transistor $T_{Sig}$ which maintains an on state in response to a signal from the scanning line SCL, the voltage to be supplied from the power supply section 100 is changed from the second voltage $V_{CC-L}$ to the first voltage $V_{CC-H}$ so that the first voltage $V_{CC-H}$ is supplied from the power supply section 100 to the first one of the source/drain regions of the driving transistor $T_{Drv}$. As a result, although the potential at the first node $ND_1$ does not vary or maintains the first node initializing voltage $V_{Ofs}=0$ volt, the potential at the second node $ND_2$ varies from the potential at the first node $ND_1$ toward a potential of the difference of the threshold voltage $V_{th}$ of the driving transistor $T_{Drv}$. In particular, the potential at the second node $ND_2$ in the floating state rises. Then, when the potential difference between the gate electrode of the driving transistor $T_{Drv}$ and the second one of the source/drain regions reaches the threshold voltage $V_{th}$, the driving transistor $T_{Drv}$ is placed into an off state. More particularly, the potential at the second node $ND_2$ in the floating state approaches $V_{Ofs}-V_{th}=-3$ volts and finally becomes equal to $V_{Ofs}-V_{th}$. Here, if the expression (2) given below is assured, or in other words, if the potentials are selected and determined so as to satisfy the expression (2), then the light emitting portion ELP does not emit light.

$$(V_{Ofs}-V_{th})<(V_{th-EL}+V_{Cat}) \tag{2}$$

Within this period $TP(2)_2$, the potential at the second node $ND_2$ finally becomes equal to $V_{Ofs}-V_{th}$. In other words, the potential at the second node $ND_2$ relies upon the threshold voltage $V_{th}$ of the driving transistor $T_{Drv}$ and the first node initializing voltage $V_{Ofs}$ for initializing the gate electrode of the driving transistor $T_{Drv}$. Therefore, the potential at the second node $ND_2$ is independent of the threshold voltage $V_{th-EL}$ of the light emitting portion ELP.

Period $TP(2)_3$ (Refer to FIGS. 4 and 5E)

Within this period, the step (c) described hereinabove, that is, the writing process described above, is carried out.

Period $TP(2)_3$ (Refer to FIG. 5E)

Next, the writing process into the driving transistor $T_{Drv}$ is carried out. More particularly, while the on state of the image signal writing transistor $T_{Sig}$ is maintained, the potential of the data line DTL is used as the image signal $V_{Sig}$ for controlling the luminance of the light emitting portion ELP. As a result, the potential at the first node $ND_1$ rises to the image signal $V_{Sig}$. The driving transistor $T_{Drv}$ is in an on state. It is to be noted that the image signal writing transistor $T_{Sig}$ may be placed into an off state once to change the potential of the data line DTL to the image signal $V_{Sig}$ for controlling the luminance of the light emitting portion ELP, whereafter the scanning line SCL is changed over to the high level to place the image signal writing transistor $T_{Sig}$ into an on state.

Figure 9:
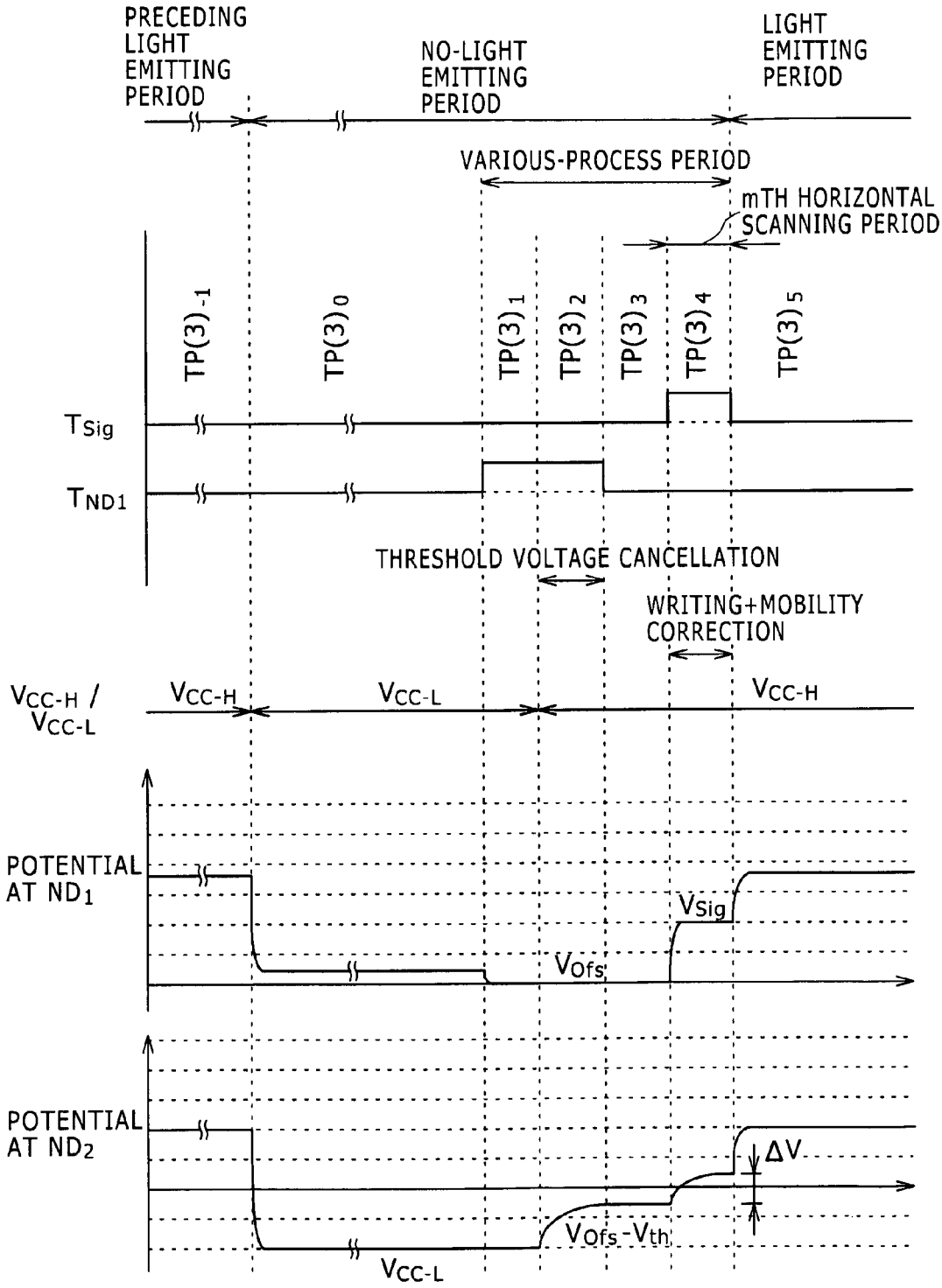
FIG. 9 is a timing chart illustrating driving of the organic EL device of FIG. 7.

Here, the capacitance of the capacitor element $C_1$ has a value $c_1$, and the capacitance of the parasitic capacitance $C_{EL}$ of the light emitting portion ELP has a value $c_{EL}$. Then, the value of the parasitic capacitance between the gate electrode and the second one of the source/drain regions of the driving transistor $T_{Drv}$ is represented by $c_{gs}$. When the potential at the gate electrode of the driving transistor $T_{Drv}$ changes from $V_{Ofs}$ to $V_{Sig}$ ($>V_{Ofs}$), the potentials at the opposite ends of the capacitor element $C_1$, that is, the potentials at the first node $ND_1$ and the second node $ND_2$, vary in principle. In particular, charge based on the variation amount $V_{Sig}-V_{Ofs}$ of the potential at the gate electrode of the driving transistor $T_{Drv}$, that is, of the potential at the first node $ND_1$, is distributed to the capacitor element $C_1$, the parasitic capacitance $C_{EL}$ of the light emitting portion ELP and the parasitic capacitance between the gate electrode and the second one of the source/drain regions of the driving transistor $T_{Drv}$. However, if the value $c_{EL}$ has a sufficiently high value in comparison the value $c_1$ and the value $c_{gs}$, then the variation of the potential at the second one of the source/drain regions of the driving transistor $T_{Drv}$, that is, at the second node $ND_2$, by the variation $V_{Sig}-V_{Ofs}$ of the potential at the gate electrode of the driving transistor $T_{Drv}$ is small. Then, generally the capacitance value $c_{EL}$ of the parasitic capacitance $C_{EL}$ of the light emitting portion ELP is higher than the capacitance value $c_1$ of the capacitor element $C_1$ and the value $c_{gs}$ of the parasitic capacitance of the driving transistor $T_{Drv}$. Therefore, for the convenience of description, the potential variation at the second node $ND_2$ which arises from a potential difference at the first node $ND_1$ is not taken into consideration unless otherwise specified. This similarly applies also to the other working examples hereinafter described. It is to be noted that also timing charts of driving shown in FIGS. 4, 9 and 14 are illustrated without taking the potential variation at the second node $ND_2$ which arises from the potential variation of the first node $ND_1$ into consideration.

In the driving method of the first working example, in a state wherein the first voltage $V_{CC-H}$ is applied from the power supply section 100 to the first one of the source/drain regions of the driving transistor $T_{Drv}$, the image signal $V_{Sig}$ is applied from the power supply section 100 to the gate electrode of the driving transistor $T_{Drv}$. Therefore, as seen in FIG. 4, the potential at the second node $ND_2$ rises within the period $TP(2)_3$. The rise amount $\Delta V$ of this potential, that is, the potential correction value, is hereinafter described. Where the potential at the gate electrode of the driving transistor $T_{Drv}$, that is, at the first node $ND_1$, is represented by $V_g$ and the potential at the second one of the source/drain regions of the driving transistor $T_{Drv}$, that is, at the second node $ND_2$, is represented by $V_s$, if the rise of the potential at the second node $ND_2$ described above is not taken into consideration, then the potential $V_g$ and the potential $V_s$ assume the following values. The potential difference between the first node $ND_1$ and the second node $ND_2$, that is, the potential difference $V_{gs}$ between the gate electrode of the driving transistor $T_{Drv}$ and the other source/drain regions which functions as the source region can be represented by the following expression (3):

$$V_g=V_{Sig}$$

$$V_s\approx V_{Ofs}-V_{th}$$

$$V_{gs}\approx V_{Sig}-(V_{Ofs}-V_{th}) \tag{3}$$

In particular, the potential difference $V_{gs}$ obtained in the writing process into the driving transistor $T_{Drv}$ relies upon the image signal $V_{Sig}$ for controlling the luminance of the light emitting portion ELP, the threshold voltage $V_{th}$ of the driving transistor $T_{Drv}$ and the first node initializing voltage $V_{Ofs}$ for initializing the gate electrode of the driving transistor $T_{Drv}$.

Thus, the potential difference $V_{gs}$ is independent of the threshold voltage $V_{th\text{-}EL}$ of the light emitting portion ELP.

Now, the mobility correction process is described briefly. In the writing process in the driving method of the first working example, the mobility correction process of raising the potential at the second one of the source/drain regions of the driving transistor $T_{Drv}$, that is, the potential at the second node $ND_2$, in accordance with the characteristic of the driving transistor $T_{Drv}$, for example, the magnitude of the mobility μ is carried out together.

Where the driving transistor $T_{Drv}$ is produced from a polycrystalline silicon thin film transistor or the like, the situation that dispersion in the mobility μ occurs among transistors may not be avoided readily. Accordingly, even if the image signal $V_{Sig}$ of an equal value is applied to the gate electrode of a plurality of driving transistors $T_{Drv}$ which are different in the mobility μ from each other, a difference appears between drain current $I_{ds}$ flowing through a driving transistor $T_{Drv}$ having a high mobility μ and drain current $I_{ds}$ flowing through another driving transistor $T_{Drv}$ having a low mobility μ. If such difference occurs, then uniformity of the screen image of the organic EL display apparatus is damaged.

As described hereinabove, in the driving method of the first working example, in a state wherein the first voltage $V_{CC\text{-}H}$ is applied from the power supply section 100 to the first one of the source/drain regions of the driving transistor $T_{Drv}$, the image signal $V_{Sig}$ is applied to the gate electrode of the driving transistor $T_{Drv}$. Therefore, as seen in FIG. 4, the potential at the second node $ND_2$ rises within the period $TP(\mathbf{2})_3$. Where the value of the mobility μ of the driving transistor $T_{Drv}$ is high, the rise amount ΔV of the potential, that is, the potential correction value, in the second one of the source/drain regions of the driving transistor $T_{Drv}$, is high. Conversely, where the value of the mobility μ of the driving transistor $T_{Drv}$ is small, the rise amount ΔV of the potential, that is, the potential correction value, in the second one of the source/drain regions of the driving transistor $T_{Drv}$, is small. Here, the potential difference $V_{gs}$ between the gate electrode of the driving transistor $T_{Drv}$ and the second one of the source/drain regions which acts as the source region is obtained from the following expression (4) which is obtained by transform of the expression (3) given hereinabove.

$$V_{gs} \approx V_{Sig} - (V_{Ofs} - V_{th}) - \Delta V \tag{4}$$

It is to be noted that a predetermined period of time for executing the writing process, that is, the total time period $t_0$ of the period $TP(\mathbf{2})_3$, may be set as a design value in advance upon designing of the organic EL display apparatus. Further, the total time period $t_0$ of the period $TP(\mathbf{2})_2$ is determined such that the potential $V_{Ofs}-V_{th}+\Delta V$ at the second one of the source/drain regions of the driving transistor $T_{Drv}$ at this time satisfies the expression (2') given below. Then, since the total time period $t_0$ is determined in this manner, the light emitting portion ELP does not emit light within the period $TP(\mathbf{2})_2$. Further, by the mobility correction process, also correction of the dispersion of the coefficient k ($\equiv(1/2)\cdot(W/L)\cdot C_{OX}$) is carried out simultaneously.

$$(V_{Ofs} - V_{th} + \Delta V) < (V_{th\text{-}EL} + V_{Cat}) \tag{2'}$$

Period $TP(\mathbf{2})_4$ (Refer to FIGS. 4 and 5F)

By the operation described above, the threshold voltage cancellation process, writing process and mobility correction process are completed. Thereafter, within this period, the step (d) described hereinabove is carried out in the following manner. In particular, in a state wherein the first voltage $V_{CC\text{-}H}$ remains applied from the power supply section 100 to the first one of the source/drain regions of the driving transistor $T_{Drv}$, the scanning line SCL is set to the low level by operation of the scanning circuit 101 to place the image signal writing transistor $T_{Sig}$ into an off state thereby to place the first node $ND_1$, that is, the gate electrode of the driving transistor $T_{Drv}$, into a floating state. As a result, the potential at the second node $ND_2$ rises.

Since the gate electrode of the driving transistor $T_{Drv}$ is in a floating state as described above and besides the capacitor element $C_1$ exists, a phenomenon similar to that which occurs with a bootstrap circuit occurs with the gate electrode of the driving transistor $T_{Drv}$, and also the potential at the first node $ND_1$ rises. As a result, the potential difference $V_{gs}$ between the gate electrode of the driving transistor $T_{Drv}$ and the second one of the source/drain regions which functions as the source region maintains the value of the expression (4).

Further, since the potential at the second node $ND_2$ rises until it exceeds $V_{th\text{-}EL}+V_{Cat}$, the light emitting portion ELP starts emission of light. At this time, since the current flowing through the light emitting portion ELP is the drain current $I_{ds}$ which flows from the drain region to the source region of the driving transistor $T_{Drv}$, it can be represented by the expression (1) given hereinabove. Here, from the expression (1) and the expression (4), the expression (1) can be transformed in such a manner as seen from the following expression (5).

$$I_{ds} = k\cdot\mu\cdot(V_{Sig} - V_{Ofs} - \Delta V)^2 \tag{5}$$

Accordingly, for example, if the first node initializing voltage $V_{Ofs}$ is set to 0 volt, then the drain current $I_{ds}$ flowing through the light emitting portion ELP increases in proportion to the square of the difference of the potential correction value ΔV at the second node $ND_2$, that is, at the second one of the source/drain regions of the driving transistor $T_{Drv}$, arising from the mobility μ of the driving transistor $T_{Drv}$ from the value of the image signal $V_{Sig}$ for controlling the luminance of the light emitting portion ELP. In other words, the drain current $I_{ds}$ flowing through the light emitting portion ELP does not rely upon the threshold voltage $V_{th\text{-}EL}$ of the light emitting portion ELP or the threshold voltage $V_{th}$ of the driving transistor $T_{Drv}$. In other words, the light emission amount or luminance of the light emitting portion ELP is not influenced by the threshold voltage $V_{th\text{-}EL}$ of the light emitting portion ELP nor by the threshold voltage $V_{th}$ of the driving transistor $T_{Drv}$. Then, the luminance of the (n, m)th organic EL device has a value corresponding to the drain current $I_{ds}$.

Besides, as the mobility μ of the driving transistor $T_{Drv}$ increases, the potential correction value ΔV increases, and consequently, the value of $V_{gs}$ on the left side of the expression (4) decreases. Accordingly, in the expression (5), even if the value of the mobility μ is high, the value of ($V_{Sig}-V_{Ofs}-\Delta V$) decreases, and as a result, the drain current $I_{ds}$ can be corrected. In particular, also in the driving transistor $T_{Drv}$ having a different mobility μ, if the value of the image signal $V_{Sig}$ is equal, then since the drain current $I_{ds}$ becomes substantially equal, the drain current $I_{ds}$ which flows through the light emitting portion ELP and controls the luminance of the light emitting portion ELP is uniformized. In other words, dispersion in luminance of the light emitting portion arising from the dispersion of the mobility μ, furthermore, from the dispersion of k, can be corrected.

Then, the light emitting state of the light emitting portion ELP is continued till the (m+m'−1)th horizontal scanning period. This point of time corresponds to the end of the period $TP(\mathbf{2})_{-1}$.

The light emitting operation of the organic EL device, that is, the (n, m)th sub pixel or organic EL device, is completed therewith.

The driving method of the first working example is such as described above.

Second Working Example

Also a second working example of the present invention is directed to an organic EL display apparatus according to the first embodiment of the present invention, a driving circuit according to the first and third embodiments of the present invention, and a driving method according to the first embodiment of the present invention.

The second working example is a modification to the first working example. The second working example is different from the first working example in the structure of the driving transistor as a component of the driving circuit. More particularly, in the second working example, not only the first LDD structure described hereinabove in connection with the first working example is provided but also a second LDD structure is formed on the second one of the source/drain regions of the driving transistor.

Figure 6A:
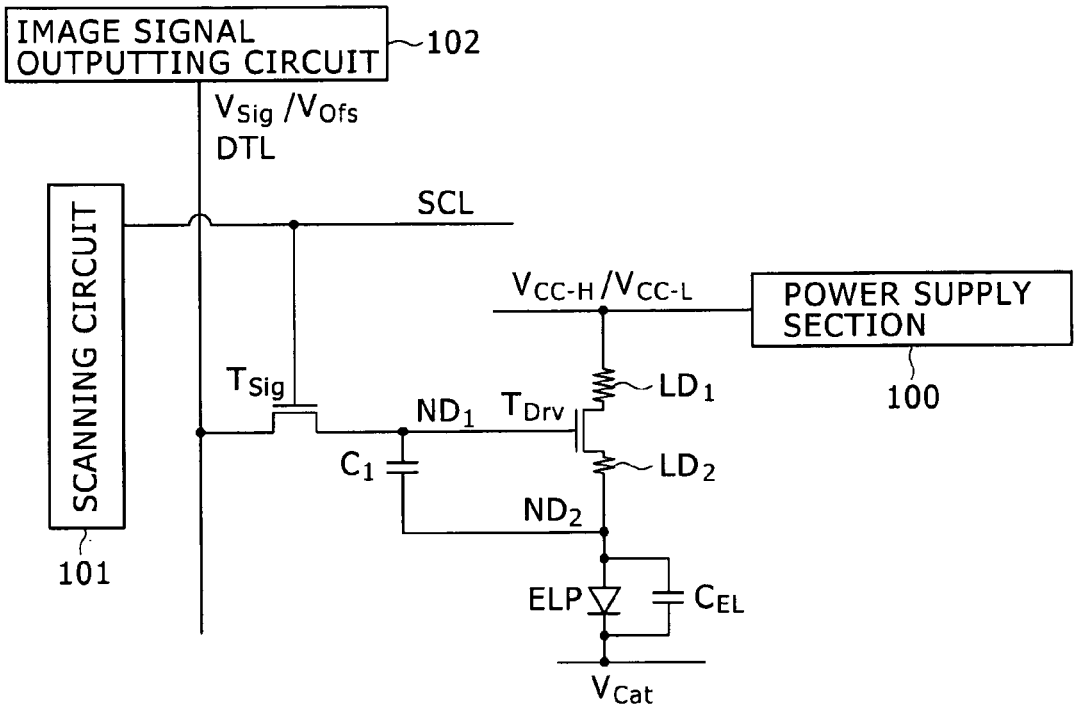
FIG. 6A is an equivalent circuit diagram of another driving circuit formed from two transistors/one capacitor element.
Figure 6B:
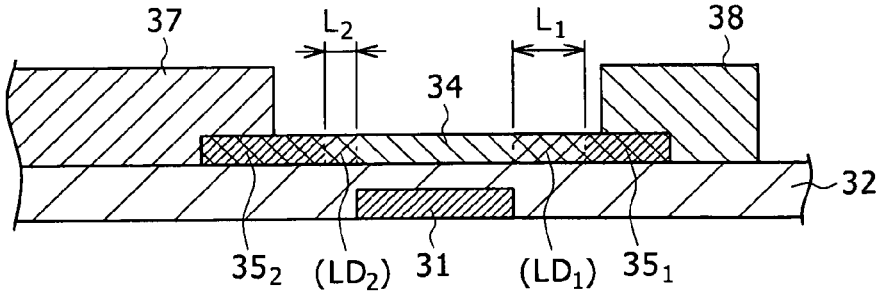
FIG. 6B is a schematic sectional view of an organic EL device in the proximity of a driving transistor.

The organic EL display apparatus of the second working example can be represented by a conceptive view similar to FIG. 2 described hereinabove. An equivalent circuit of the driving circuit of the second working example is shown in FIG. 6A. FIG. 6B shows a schematic sectional view taken in the proximity of the driving transistor and corresponds to FIG. 3B referred to in the description of the first working example.

As seen in FIGS. 6A and 6B, in the second working example, in addition to the first LDD structure $LD_1$ described hereinabove in connection with the first working example, a second LDD structure $LD_2$ is formed adjacent the second one of the source/drain regions of the driving transistor $T_{Drv}$. Further, the length $L_2$ of the second LDD structure $LD_2$ is smaller than the length $L_1$ of the first LDD structure $LD_1$ adjacent the first one of the source/drain regions of the driving transistor $T_{Drv}$.

Except the difference of the structure of the driving transistor $T_{Drv}$ which is a component of the driving circuit described above, the structure and the configuration of the organic EL display apparatus and the driving circuit of the second working example are similar to those described in connection with the first working example. Further, operation of the driving circuit of the second working example and the driving method of the second working example are similar to those described hereinabove in connection with the first working example, and therefore, overlapping description of them is omitted herein to avoid redundancy. In the second working example, since the length $L_2$ of the second LDD structure $LD_2$ is set smaller than the length $L_1$ of the first LDD structure $LD_1$ adjacent the first one of the source/drain regions of the driving transistor $T_{Drv}$, increase of the resistance component by formation of the second LDD structure is suppressed. Consequently, improvement of the linearity of the saturation characteristic of the driving transistor upon light emission of the organic EL device and improvement of the responsivity of the driving transistor in the pre-process and the threshold voltage cancellation process can be anticipated.

Third Working Example

A third working example of the present invention is directed to an organic EL display apparatus according to the second embodiment of the present invention, a driving circuit according to the second and third embodiments of the present invention, and a driving method according to the second embodiment of the present invention.

Figure 7:
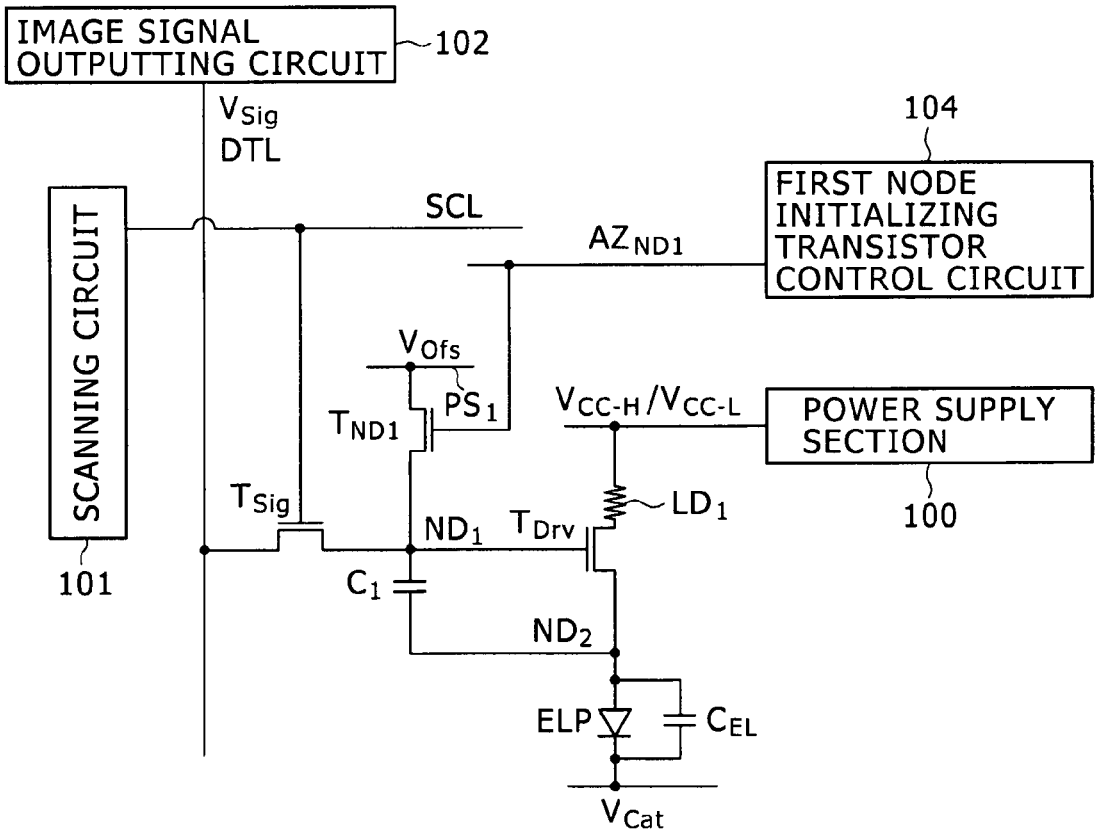
FIG. 7 is an equivalent circuit of a driving circuit formed from 3-transistors/one capacitor element.

An equivalent circuit of the driving circuit of the third working example is shown in FIG. 7. A schematic view illustrating a concept of the organic EL display apparatus of the third working example is shown in FIG. 8. A timing chart illustrating driving of the organic EL device is illustrated in FIG. 9. Further, on/off states of transistors of the driving circuit of the organic EL device are schematically illustrated in FIGS. 10A to 10F.

As seen in FIG. 7, the driving circuit of the third working example is basically configured such that a first node initializing transistor $T_{ND1}$ is added to the driving circuit of the first working example shown in FIG. 1. The structure and the configuration of the organic EL display apparatus and the driving apparatus are basically similar to those described hereinabove in connection with the first working example except that the first node initializing transistor $T_{ND1}$ and a first node initializing transistor control line $AZ_{ND1}$ and a first node initializing transistor control circuit 104 shown in FIGS. 7 and 8 are additionally provided.

The driving circuit of the third working example is composed of three transistors and one capacitor element $C_1$. The driving circuit of the type just described is hereinafter referred to sometimes as 3Tr/1C driving circuit. In particular, the driving circuit of the third working example includes (A) a driving transistor $T_{Drv}$, (B) an image signal writing transistor $T_{Sig}$, and (C) a capacitor element $C_1$ having a pair of electrodes similarly to the driving circuit of the first working example, and further includes (D) a first node initializing transistor $T_{ND1}$.

The first node initializing transistor $T_{ND1}$ is formed from an n-channel TFT which has source/drain regions, a channel formation region and a gate electrode. However, the first node initializing transistor $T_{ND1}$ may otherwise be formed from a p-channel TFT.

The first node initializing transistor $T_{ND1}$ is configured such that (D-1) a first one of the source/drain regions is connected to a first node initializing voltage supply line $PS_1$, (D-2) the second one of the source/drain regions is connected to the first node $ND_1$, and (D-3) the gate electrode is connected to the first node initializing transistor control line $AZ_{ND1}$.

The first node initializing transistor control line $AZ_{ND1}$ is connected at one end thereof to the first node initializing transistor control circuit 104. The first node initializing voltage $V_{Ofs}$ is applied to the first node initializing voltage supply line $PS_1$.

The structure of the transistors and the capacitor element $C_1$ which compose the driving circuit of the third working example is similar to that described hereinabove with reference to FIGS. 3A and 3B in connection with the first working example including the LDD structure $LD_1$ shown in FIG. 7. Therefore, overlapping description of the structure is omitted herein to avoid redundancy.

The configuration of the organic EL display apparatus of the third working example and the driving circuit for driving the light emitting portion ELP is described above. Similarly as in the first working example described above, in the driving circuit of the third working example, the number of transistors can be reduced. Consequently, facilitation in production, improvement of the yield and so forth of the organic EL display apparatus can be anticipated. The LDD structure $LD_1$ provides an effect similar to that achieved by the first working example.

Now, the driving method for the light emitting portion ELP in which the driving circuit of the third working example described above is used is described. In the driving method of the first working example, the first node initializing voltage $V_{Ofs}$ is applied from the data line DTL to the first node $ND_1$ through the image signal writing transistor $T_{Sig}$. The driving method of the third working example is different principally in that the first node initializing voltage $V_{Ofs}$ is applied through the first node initializing transistor $T_{ND1}$.

In the driving method of the third working example, (a) a pre-process of applying the first node initializing voltage $V_{Ofs}$ from the first node initializing voltage supply line $PS_1$ to the first node $ND_1$ through the first node initializing transistor $T_{ND1}$, which is placed in an on state by a signal from the first node initializing transistor control line $AZ_{ND1}$, so that the potential difference between the first node $ND_1$ and the second node $ND_2$ may exceed the threshold voltage $V_{th}$ of the driving transistor $T_{Drv}$ and applying the second voltage $V_{CC-L}$ from the power supply section 100 to the first one of the source/drain regions of the driving transistor $T_{Drv}$ is carried out.

More particularly, in the driving method of the third working example, at the step (a) described hereinabove, the first node initializing voltage $V_{Ofs}$ is applied from the first node initializing voltage supply line $PS_1$ to the first node $ND_1$ through the first node initializing transistor $T_{ND1}$ which is placed in an on state in response to a signal from the first node initializing transistor control line $AZ_{ND1}$ by operation of the first node initializing transistor control circuit 104.

In the driving method of the third working example, (b) a threshold voltage cancellation process of applying, in a state wherein the first node initializing voltage $V_{Ofs}$ remains applied from the first node initializing voltage supply line $PS_1$ to the first node $ND_1$ through the first node initializing transistor $T_{ND1}$ which maintains an on state in response to a signal from the first node initializing transistor control line $AZ_{ND1}$, the first voltage $V_{CC-H}$ from the power supply section 100 to the first one of the source/drain regions of the driving transistor $T_{Drv}$ thereby to cause the potential at the second node $ND_2$ to vary toward the potential of the difference of the threshold voltage $V_{th}$ of the driving transistor $T_{Drv}$ from the potential at the first node $ND_1$ in a state wherein the potential at the first node $ND_1$ is maintained is carried out.

In the driving method of the third working example, (c) a writing process of applying the image signal $V_{Sig}$ from the data line DTL to the first node $ND_1$ through the image signal writing transistor $T_{Sig}$, which is placed in an on state by a signal from the scanning line SCL, is carried out subsequently.

More particularly, in the driving method of the third working example, at the step (c) described above, in a state wherein the first node initializing transistor $T_{ND1}$ is placed in an off state in accordance with a signal from the first node initializing transistor control line $AZ_{ND1}$ by operation of the first node initializing transistor control circuit 104, the image signal $V_{Sig}$ is applied to the first node $ND_1$ by operation of the image signal outputting circuit 102 through the image signal writing transistor $T_{Sig}$ which is placed in an on state in accordance with a signal from the scanning line SCL by operation of the scanning circuit 101.

Thereafter, in the driving method of the third working example, (d) the image signal writing transistor $T_{Sig}$ is placed into an off state in accordance with a signal from the scanning line SCL thereby to place the first node $ND_1$ into a floating state, and current according to the value of the potential difference between the first node $ND_1$ and the second node $ND_2$ is supplied from the power supply section 100 to the light emitting portion ELP through the driving transistor $T_{Drv}$ to drive the light emitting portion ELP.

More particularly, similarly as in the first working example, at the step (d) described above, the image signal writing transistor $T_{Sig}$ is placed into an off state in response to a signal from the scanning line SCL by operation of the scanning circuit 101 to place the first node $ND_1$ into a floating state. Then, current according to the value of the potential difference between the first node $ND_1$ and the second node $ND_2$ is supplied from the power supply section 100 to the light emitting portion ELP to drive the light emitting portion ELP.

It is to be noted that, also in the third working example, the mobility correction process is carried out substantially together with the writing process at the step (c) described above similarly as in the first working example.

The steps (a), (b), (c) and (d) described above are described below with reference to FIGS. 9 and 10A to 10F.

Period $TP(\mathbf{3})_{-1}$ (Refer to FIGS. 9 and 10A)

This period $TP(\mathbf{3})_{-1}$ is a period within which, for example, operation in the preceding display frame is carried out. The operation within this period $TP(\mathbf{3})_{-1}$ is substantially same as that within the period $TP(\mathbf{2})_{-1}$ described hereinabove in connection with the first working example. Here, the image signal writing transistor $T_{Sig}$ and the first node initializing transistor $T_{ND1}$ are in an off state, and the driving transistor $T_{Drv}$ is in an on state.

The periods from the period $TP(\mathbf{3})_0$ to the period $TP(\mathbf{3})_3$ illustrated in FIG. 9 correspond to the periods from the period $TP(\mathbf{2})_0$ to the period $TP(\mathbf{2})_2$ illustrated in FIG. 4, and are an operation period till a point of time immediately before a next writing process is carried out. Then, similarly to the driving circuit of the first working example, the (n, m)th organic EL device is in a no-light emitting state in principle within the periods from the period $TP(\mathbf{3})_0$ to the period $TP(\mathbf{3})_3$. However, operation of the driving circuit of the third working example is different from the operation of the driving circuit of the first working example in that not only the period $TP(\mathbf{3})_0$ but also the periods from the period $TP(\mathbf{3})_1$ to the period $TP(\mathbf{3})_3$ precede to the mth horizontal scanning period. It is to be noted that, for the convenience of description, it is assumed that the starting timing and the ending timing of the period $TP(\mathbf{3})_4$ coincide with the starting timing and the ending timing of the mth horizontal period, respectively.

The periods from the period $TP(\mathbf{3})_0$ to the period $TP(\mathbf{3})_3$ are described below. It is to be noted that, similarly as in the description given hereinabove in connection with the first working example, the length of each of the periods from the period $TP(\mathbf{3})_0$ to the period $TP(\mathbf{3})_3$ may be set suitably in accordance with the design of the organic EL display apparatus.

Period $TP(\mathbf{3})_0$ (Refer to FIG. 10B)

Operation within the period $TP(\mathbf{3})_0$ is, for example, a period from a preceding display frame to a current display frame, and is substantially same as that in the period $TP(\mathbf{2})_0$ described hereinabove in connection with the driving circuit of the first working example. In particular, at a point of time of transition from the period $TP(\mathbf{3})_{-1}$ to the period $TP(\mathbf{3})_0$, the voltage to be supplied from the power supply section 100 is changed from the first voltage $V_{CC-H}$ to the second voltage $V_{CC-L}$. As a result, the voltage at the second node $ND_2$, that is, at the second one of the source/drain regions of the driving transistor $T_{Drv}$, drops to the second voltage $V_{CC-L}$, and the light emitting portion ELP is placed into a no-light emitting state. Further, also the potential at the first node $ND_1$ in a floating state, that is, at the gate electrode of the driving transistor $T_{Drv}$, drops in such a manner as to follow the potential drop at the second node $ND_2$.

Period $TP(3)_1$ (Refer to FIGS. 9 and 10C)

Within this period, the step (a) described hereinabove, that is, the pre-process described hereinabove, is carried out.

The state wherein the second voltage $V_{CC-L}$ is applied from the power supply section 100 to the first one of the source/drain regions of the driving transistor $T_{Drv}$ is maintained, and upon starting of the period $TP(3)_1$, the first node initializing transistor control line $AZ_{ND1}$ is placed into the high level by operation of the first node initializing transistor control circuit 104 to place the first node initializing transistor $T_{ND1}$ into an on state. Thus, the first node initializing voltage $V_{Ofs}$ is applied from the first node initializing voltage supply line $PS_1$ to the first node $ND_1$ through the first node initializing transistor $T_{ND1}$ placed in an on state.

As a result, the potential at the first node $ND_1$ becomes equal to the first node initializing voltage $V_{Ofs}$ which is 0 volt. On the other hand, the potential at the second node $ND_2$ is equal to the second voltage $V_{CC-L}$ which is −10 volts. Since the potential difference between the first node $ND_1$ and the second node $ND_2$ is 10 volts and the threshold voltage $V_{th}$ of the driving transistor $T_{Drv}$ is 3 volts, the driving transistor $T_{Drv}$ is in an on state. It is to be noted that the potential difference between the second node $ND_2$ and the cathode electrode provided on the light emitting portion ELP is −10 volts and does not exceed the threshold voltage $V_{th-EL}$ of the light emitting portion ELP.

Period $TP(3)_2$ (Refer to FIGS. 9 and 10D)

Within this period, the step (b) described hereinabove, that is, the threshold voltage cancellation process described hereinabove, is carried out.

In particular, in a state wherein the first node initializing voltage $V_{Ofs}$ is applied from the first node initializing voltage supply line $PS_1$ to the first node $ND_1$ through the first node initializing transistor $T_{ND1}$ which maintains an on state in response to a signal from the first node initializing transistor control line $AZ_{ND1}$, the voltage to be supplied from the power supply section 100 is changed over from the second voltage $V_{CC-L}$ to the first voltage $V_{CC-H}$ so that the first voltage $V_{CC-H}$ is applied from the power supply section 100 to the first one of the source/drain regions of the driving transistor $T_{Drv}$. As a result, although the potential at the first node $ND_1$ does not vary but maintains the first node initializing voltage $V_{Ofs}=0$ volt, the potential at the second node $ND_2$ varies toward the potential of the difference of the threshold voltage $V_{th}$ of the driving transistor $T_{Drv}$ from the potential at the first node $ND_1$. In particular, the potential at the second node $ND_2$ in the floating state rises. Then, if the potential difference between the gate electrode of the driving transistor $T_{Drv}$ and the second one of the source/drain regions of the driving transistor $T_{Drv}$ reaches the threshold voltage $V_{th}$, then the driving transistor $T_{Drv}$ is placed into an off state. More particularly, the potential at the second node $ND_2$ in the floating state approaches $V_{Ofs}-V_{th}=-3$ volts and finally becomes equal to $V_{Ofs}-V_{th}$. Here, if the expression (2) given hereinabove is assured, or in other words, if the potentials are selected so as to satisfy the expression (2), then the light emitting portion ELP does not emit light at all.

Within this period $TP(3)_2$, the potential at the second node $ND_2$ finally becomes equal to $V_{Ofs}-V_{th}$. In other words, the potential at the second node $ND_2$ relies upon the threshold voltage $V_{th}$ of the driving transistor $T_{Drv}$ and the first node initializing voltage $V_{Ofs}$ for initializing the gate electrode of the driving transistor $T_{Drv}$. Thus, the potential at the second node $ND_2$ is independent of the threshold voltage $V_{th-EL}$ of the light emitting portion ELP.

Period $TP(3)_3$ (Refer to FIG. 9)

Thereafter, the first node initializing transistor control line $AZ_{ND1}$ is placed into the low level by operation of the first node initializing transistor control circuit 104 to place the first node initializing transistor $T_{ND1}$ into an off state. As a result, the potential at the first node $ND_1$ does not vary but maintains the first node initializing voltage $V_{Ofs}=0$ volt, and also the potential at the second node $ND_2$ in the floating state does not vary but maintains $V_{Ofs}-V_{th}=-3$ volts.

Now, the periods from the period $TP(3)_4$ to the period $TP(3)_5$ are described. The periods mentioned correspond to the periods from the period $TP(2)_3$ to the period $TP(2)_4$ described hereinabove in connection with the driving circuit of the first working example.

Period $TP(3)_4$ (Refer to FIGS. 9 and 10E)

Within this period, the step (c) described hereinabove, that is, the writing process described hereinabove, is carried out. The potential of the data line DTL is set to the image signal $V_{Sig}$ for controlling the luminance of the light emitting portion ELP by operation of the image signal outputting circuit 102. Then, the image signal $V_{Sig}$ is applied from the data line DTL to the first node $ND_1$ through the image signal writing transistor $T_{Sig}$, which is placed in an on state in accordance with a signal from the scanning line SCL, by operation of the scanning circuit 101. As a result, the potential at the first node $ND_1$ rises to the image signal $V_{Sig}$.

Also in the driving method of the third working example, similarly as in the driving method of the first working example, in a state wherein the first voltage $V_{CC-H}$ is applied from the power supply section 100 to the first one of the source/drain regions of the driving transistor $T_{Drv}$, the image signal $V_{Sig}$ is applied to the gate electrode of the driving transistor $T_{Drv}$. Therefore, similarly as in the driving method of the first working example, the potential at the second node $ND_2$ rises within the period $TP(3)_4$. The rise amount $\Delta V$ of the potential, that is, the potential correction value, is similar to that described hereinabove in connection with the first working example, and therefore, overlapping description of the same is omitted herein to avoid redundancy. The potential difference $V_{gs}$ between the gate electrode of the driving transistor $T_{Drv}$ and the second one of the source/drain regions which functions as the source region is given by the expression (4) given hereinabove.

It is to be noted that, similarly as in the first working example, the predetermined period of time for executing the writing process, that is, the total time period $t_0$ of the period $TP(3)_4$, may be determined in advance as a designed value upon designing of the organic EL display apparatus. Further, the total time $t_0$ of the period $TP(3)_4$ is determined such that the potential $V_{Ofs}-V_{th}+\Delta V$ at the second one of the source/drain regions of the driving transistor $T_{Drv}$ at this time satisfies the expression (2) given hereinabove. Consequently, the light emitting portion ELP does not emit light at all within the period $TP(3)_4$. Further, by the mobility correction process described, also correction of the dispersion of the coefficient $k\ (\equiv(1/2)\cdot(W/L)\cdot C_{OX})$ is carried out simultaneously.

Period $TP(3)_5$ (Refer to FIGS. 9 and 10F)

By the operation described above, the threshold voltage cancellation process, writing process and mobility correction process are completed. Thereafter, within the period, operation of the step (d) described above is carried out. In particular, in a state wherein the first voltage $V_{CC-H}$ remains applied from the power supply section 100 to the first one of the source/drain regions of the driving transistor $T_{Drv}$, the scanning line SCL is placed into the low level by operation of the scanning circuit 101 to place the image signal writing transistor $T_{Sig}$ into an off state thereby to place the first node $ND_1$, that is, the gate electrode of the driving transistor $T_{Drv}$, into a floating state. Accordingly, as a result of the foregoing, the potential at the second node $ND_2$ rises until it exceeds $V_{th-EL}+V_{Cat}$. Consequently, the light emitting portion ELP starts emission of light. At this time, the current flowing through the light emitting portion ELP can be obtained in accordance with the expression (5) given hereinabove. Therefore, the drain current $I_{ds}$ flowing through the light emitting portion ELP does not rely upon the threshold voltage $V_{th-EL}$ of the light emitting portion ELP nor upon the threshold voltage $V_{th}$ of the driving transistor $T_{Drv}$. In other words, the emitted light amount or luminance of the light emitting portion ELP is not influenced by the threshold voltage $V_{th-EL}$ of the light emitting portion ELP nor by the threshold voltage $V_{th}$ of the driving transistor $T_{Drv}$. In addition, occurrence of a dispersion of the drain current $I_{ds}$ arising from a dispersion of the mobility μ of the driving transistor $T_{Drv}$ can be suppressed.

Then, the light emitting state of the light emitting portion ELP continues till the (m+m'−1)th horizontal scanning period. This point of time corresponds to the end of the period $TP(\mathbf{3})_{-1}$.

By the foregoing, the light emitting operation of the organic EL device, that is, of the (n, m)th sub pixel or organic EL device, is completed.

Fourth Working Example

Also a fourth working example is directed to an organic EL display apparatus according to the second embodiment of the present invention, a driving circuit according to the second and third embodiments of the present invention, and a driving method according to the second embodiment of the present invention.

The fourth working example is a modification to the third working example. The fourth working example is different from the third working example in the structure of the driving transistor which composes the driving circuit. More particularly, in the present fourth working example, not only the first LDD structure described hereinabove in the third working example but also the second LDD structure are formed in the second one of the source/drain regions of the driving transistor.

Figure 8:
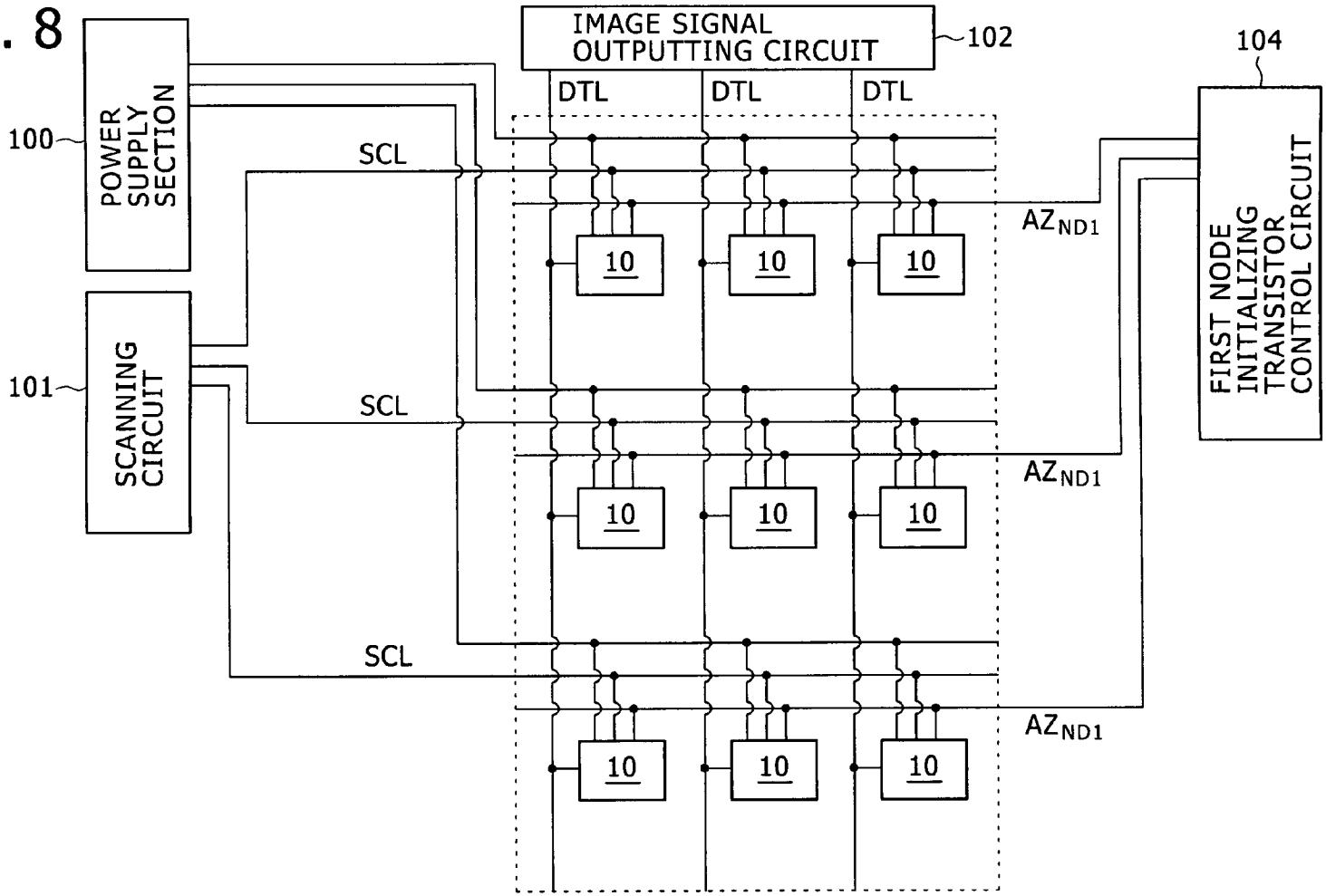
FIG. 8 is a schematic view illustrating a concept of another organic EL display apparatus.

A schematic view illustrating a concept of the organic EL display apparatus of the fourth working example is similar to that of FIG. 8. An equivalent circuit diagram of the driving circuit of the fourth working example is shown in FIG. 11.

Figure 11:
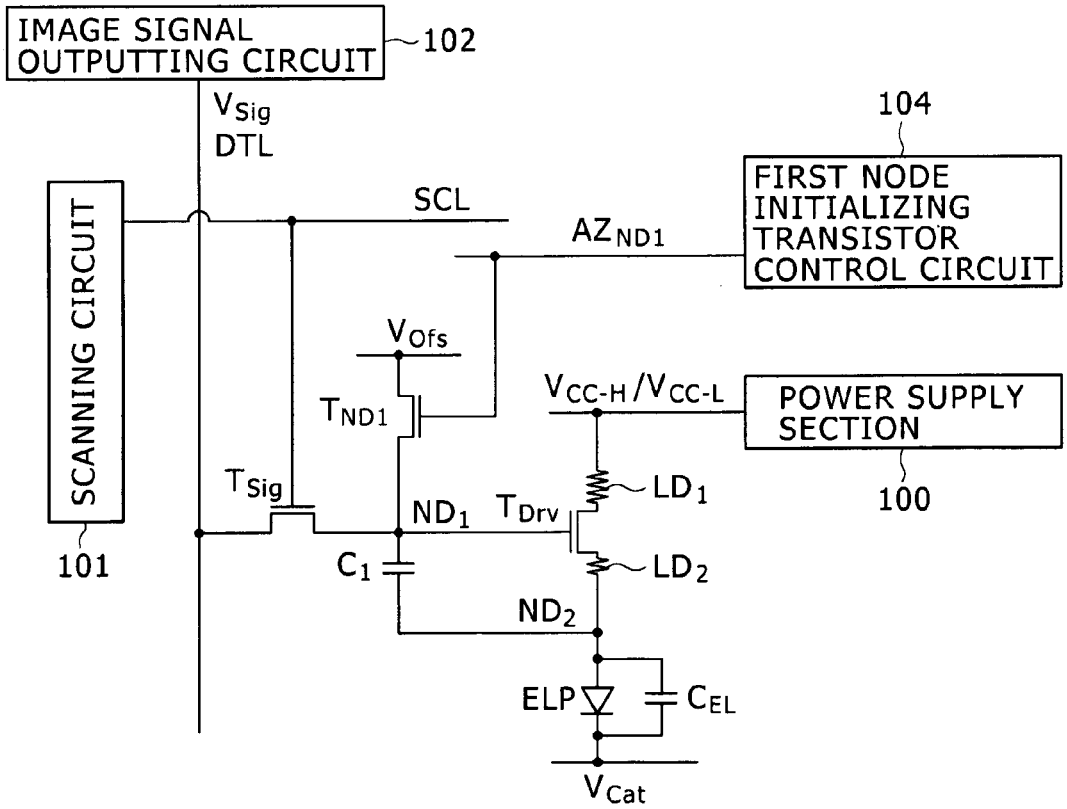
FIG. 11 is an equivalent circuit of another driving circuit formed from 3-transistors/one capacitor element.

Referring to FIG. 11, in the fourth working example, in addition to the first LDD structure $LD_1$ described hereinabove in connection with the third working example, the second LDD structure $LD_2$ is formed on the second one of the source/drain regions of the driving transistor $T_{Drv}$. The length $L_2$ of the second LDD structure $LD_2$ is smaller than the length $L_1$ of the first LDD structure $LD_1$ on the first one of the source/drain regions of the driving transistor $T_{Drv}$.

The structure of the transistors and the capacitor element $C_1$ which compose the driving circuit of the fourth working example is similar to that described hereinabove with reference to FIGS. 6A and 6B in connection with the second working example including the LDD structures $LD_1$ and $LD_2$ shown in FIG. 11. Therefore, overlapping description of the structure is omitted herein to avoid redundancy.

Except the difference of the structure of the driving transistor $T_{Drv}$ which is a component of the driving circuit described above, the structure and the configuration of the organic EL display apparatus and the driving circuit of the fourth working example are similar to those described in connection with the third working example. Further, operation of the driving circuit of the fourth working example and the driving method of the fourth working example are similar to those described hereinabove in connection with the third working example, and therefore, overlapping description of them is omitted herein to avoid redundancy. In the fourth working example, the length $L_2$ of the second LDD structure $LD_2$ is set smaller than the length $L_1$ of the first LDD structure $LD_1$ adjacent the first one of the source/drain regions of the driving transistor $T_{Drv}$. Consequently, increase of the resistance component by formation of the second LDD structure is suppressed, and improvement of the linearity of the saturation characteristic of the driving transistor upon light emission of the organic EL device and improvement of the responsivity of the driving transistor in the pre-process and the threshold voltage cancellation process can be anticipated.

Although the present invention is described above in connection with the preferred working examples thereof, the present invention is not limited to the working examples. The configuration and the structure of the various components of the organic EL display apparatus, organic EL device and driving circuit described in connection with the working examples and the steps of the driving method for the light emitting portion are merely illustrative and can be modified suitably. It is to be noted that the steps of the driving method according to an embodiment of the present invention can be applied without relying upon the LDD structure of the driving transistor.

What is claimed is:

1. A driving method for an organic electroluminescence light emitting portion using a driving circuit for driving the organic electroluminescence light emitting portion, the organic electroluminescence light emitting portion including (A) a driving transistor of the n channel type having source/drain regions, a channel formation region and a gate electrode, (B) an image signal writing transistor having source/drain regions, a channel formation region and a gate electrode, and (C) a capacitor element having a pair of electrodes, the driving transistor being configured such that (A-1) a first one of the source/drain regions is connected to a power supply section, that (A-2) a second one of the source/drain regions is connected to an anode electrode provided on the organic electroluminescence light emitting portion and also to one of the electrodes of the capacitor element in such a manner as to form a second node, and that (A-3) the gate electrode is connected to the second one of the source/drain regions of the image signal writing transistor and also to the other electrode of the capacitor element in such a manner as to form a first node, the image signal writing transistor being configured such that (B-1) a first one of the source/drain regions is connected to a data line, and (B-2) the gate electrode is connected to a scanning line;

the driving circuit further including (D) a first node initializing transistor having source/drain regions, a channel formation region and a gate electrode;

the first node initializing transistor being configured such that (D-1) a first one of the source/drain regions is connected to a first node initializing voltage supply line, that (D-2) a second one of the source/drain regions is connected to the first node, and that (D-3) the gate electrode is connected to a first node initializing transistor control line, a first voltage for supplying current toward the organic electroluminescence light emitting portion through the driving transistor and a second voltage for preventing a potential difference between the second node and a cathode electrode provided on the organic electroluminescence light emitting portion from exceeding a threshold voltage of the organic electroluminescence light emitting portion being selectively applied from the power supply section to the first one of the source/drain regions of the driving transistor, and a lightly doped drain structure being formed adjacent the first one of the source/drain regions of the driving transistor, said driving method for an organic electroluminescence light emitting portion comprising the steps of:

(a) carrying out a pre-process of applying a first node initializing voltage from the first node initializing voltage supply line to the first node through the first node initializing transistor, which is placed in an on state by a signal from the first node initializing transistor control line, so that the potential difference between the first node and the second node may exceed the threshold voltage of the driving transistor and applying the second voltage from the power supply section to the first one of the source/drain regions of the driving transistor;

(b) carrying out a threshold voltage cancellation process of applying, in a state wherein the first node initializing voltage remains applied from the first node initializing voltage supply line to the first node through the first node initializing transistor which maintains an on state in response to a signal from the first node initializing transistor control line, the first voltage from the power supply section to the first one of the source/drain regions of the driving transistor to cause the potential at the second node to vary toward the potential of the difference of the threshold voltage of the driving transistor from the potential at the first node in a state wherein the potential at the first node is maintained;

(c) carrying out a writing process of applying the image signal from the data line to the first node through the image signal writing transistor, which is placed in an on state by a signal from the scanning line; and (d) carrying out a process of placing the image signal writing transistor into an off state in accordance with a signal from the scanning line to place the first node into a floating state and supplying current according to the value of the potential difference between the first node and the second node from the power supply section to the organic electroluminescence light emitting portion through the driving transistor.

2. The driving method for an organic electroluminescence light emitting portion according to claim 1, wherein a second lightly doped drain structure is formed adjacent the second one of said source/drain regions of said driving transistor and has a length smaller than that of the lightly doped drain structure formed adjacent the first one of said source/drain regions of said driving transistor.

3. An organic electroluminescence display apparatus, comprising:

(1) a scanning circuit;

(2) an image signal outputting circuit;

(3) totaling N×M organic electroluminescence devices arranged in a two-dimensional matrix wherein N organic electroluminescence devices are arranged in a first direction and M organic electroluminescence devices are arranged in a second direction different from the first direction and each including an organic electroluminescence light emitting portion and a driving circuit for driving the organic electroluminescence light emitting portion;

(4) M scanning lines connected to said scanning circuit and extending in the first direction;

(5) N data lines connected to said image signal outputting circuit and extending in the second direction; and (6) a power supply section;

said driving circuit including (A) a driving transistor of the n channel type having source/drain regions, a channel formation region and a gate electrode, (B) an image signal writing transistor having source/drain regions, a channel formation region and a gate electrode, and (C) a capacitor element having a pair of electrodes;

said driving transistor being configured such that (A-1) a first one of said source/drain regions is connected to a power supply section, that (A-2) a second one of said source/drain regions is connected to an anode electrode provided on the organic electroluminescence light emitting portion and also to one of the electrodes of said capacitor element in such a manner as to form a second node, and that (A-3) the gate electrode is connected to the second one of said source/drain regions of said image signal writing transistor and also to the other electrode of said capacitor element in such a manner as to form a first node;

said image signal writing transistor being configured such that (B-1) a first one of said source/drain regions is connected to a data line, and (B-2) the gate electrode is connected to a scanning line;

a first voltage for supplying current toward the organic electroluminescence light emitting portion through said driving transistor and a second voltage for preventing a potential difference between the second node and a cathode electrode provided on the organic electroluminescence light emitting portion from exceeding a threshold voltage of the organic electroluminescence light emitting portion being selectively applied from the power supply section to the first one of said source/drain regions of said driving transistor; and a lightly doped drain structure being formed adjacent the first one of said source/drain regions of said driving transistor.

4. The organic electroluminescence display apparatus according to claim 3, wherein a second lightly doped drain structure is formed adjacent the second one of said source/drain regions of said driving transistor and has a length smaller than that of the lightly doped drain structure formed adjacent the first one of said source/drain regions of said driving transistor.

5. An organic electroluminescence display apparatus, comprising:

(1) a scanning circuit;

(2) an image signal outputting circuit;

(3) totaling N×M organic electroluminescence devices arranged in a two-dimensional matrix wherein N organic electroluminescence devices are arranged in a first direction and M organic electroluminescence devices are arranged in a second direction different from the first direction and each including an organic electroluminescence light emitting portion and a driving circuit for driving the organic electroluminescence light emitting portion;

(4) M scanning lines connected to said scanning circuit and extending in the first direction;

(5) N data lines connected to said image signal outputting circuit and extending in the second direction; and (6) a power supply section;

said driving circuit including (A) a driving transistor of the n channel type having source/drain regions, a channel formation region and a gate electrode, (B) an image signal writing transistor having source/drain regions, a channel formation region and a gate electrode, and (C) a capacitor element having a pair of electrodes;

said driving transistor being configured such that (A-1) a first one of said source/drain regions is connected to a power supply section, that (A-2) a second one of said source/drain regions is connected to an anode electrode provided on the organic electroluminescence light emitting portion and also to one of the electrodes of said capacitor element in such a manner as to form a second node, and that (A-3) the gate electrode is connected to the second one of said source/drain regions of said image signal writing transistor and also to the other electrode of said capacitor element in such a manner as to form a first node;

said image signal writing transistor being configured such that (B-1) a first one of said source/drain regions is connected to a data line, and (B-2) the gate electrode is connected to a scanning line;

said driving circuit further including (D) a first node initializing transistor having source/drain regions, a channel formation region and a gate electrode;

said first node initializing transistor being configured such that (D-1) a first one of the source/drain regions is connected to a first node initializing voltage supply line, that (D-2) a second one of the source/drain regions is connected to the first node, and that (D-3) the gate electrode is connected to a first node initializing transistor control line;

a first voltage for supplying current toward the organic electroluminescence light emitting portion through said driving transistor and a second voltage for preventing a potential difference between the second node and a cathode electrode provided on the organic electroluminescence light emitting portion from exceeding a threshold voltage of the organic electroluminescence light emitting portion being selectively applied from the power supply section to the first one of said source/drain regions of said driving transistor; and a lightly doped drain structure being formed adjacent the first one of said source/drain regions of said driving transistor.

6. The organic electroluminescence display apparatus according to claim 5, wherein a second lightly doped drain structure is formed adjacent the second one of said source/drain regions of said driving transistor and has a length smaller than that of the lightly doped drain structure formed adjacent the first one of said source/drain regions of said driving transistor.

7. A driving circuit for driving an organic electroluminescence light emitting portion, comprising:

a driving transistor of the n channel type having source/drain regions, a channel formation region and a gate electrode;

a first one of said source/drain regions of said driving transistor being connected to a power supply section while a second one of said source/drain regions of said driving transistor is connected to an anode electrode provided on the organic electroluminescence light emitting portion;

a first voltage for supplying current toward the organic electroluminescence light emitting portion through said driving transistor and a second voltage for preventing a potential difference between the second one of said source/drain regions of said driving transistor connected to said anode electrode and a cathode electrode provided on the organic electroluminescence light emitting portion from exceeding a threshold voltage of the organic electroluminescence light emitting portion being selectively applied from the power supply section to the first one of said source/drain regions of said driving transistor; and a lightly doped drain structure being formed adjacent the first one of said source/drain regions of said driving transistor.

8. The driving circuit for driving an organic electroluminescence light emitting portion according to claim 7, wherein a second lightly doped drain structure is formed adjacent the second one of said source/drain regions of said driving transistor and has a length smaller than that of the lightly doped drain structure formed adjacent the first one of said source/drain regions of said driving transistor.

9. A driving circuit for driving an organic electroluminescence light emitting portion, comprising:

(A) a driving transistor of the n channel type having source/drain regions, a channel formation region and a gate electrode;

(B) an image signal writing transistor having source/drain regions, a channel formation region and a gate electrode; and (C) a capacitor element having a pair of electrodes;

said driving transistor being configured such that (A-1) a first one of said source/drain regions is connected to a power supply section, that (A-2) a second one of said source/drain regions is connected to an anode electrode provided on the organic electroluminescence light emitting portion and also to one of the electrodes of said capacitor element in such a manner as to form a second node, and that (A-3) the gate electrode is connected to the second one of said source/drain regions of said image signal writing transistor and also to the other electrode of said capacitor element in such a manner as to form a first node;

said image signal writing transistor being configured such that (B-1) a first one of said source/drain regions is connected to a data line, and (B-2) the gate electrode is connected to a scanning line;

a first voltage for supplying current toward the organic electroluminescence light emitting portion through said driving transistor and a second voltage for preventing a potential difference between the second node and a cathode electrode provided on the organic electroluminescence light emitting portion from exceeding a threshold voltage of the organic electroluminescence light emitting portion being selectively applied from the power supply section to the first one of said source/drain regions of said driving transistor; and a lightly doped drain structure being formed adjacent the first one of said source/drain regions of said driving transistor.

10. The driving circuit for driving an organic electroluminescence light emitting portion according to claim 9, wherein a second lightly doped drain structure is formed adjacent the second one of said source/drain regions of said driving transistor and has a length smaller than that of the lightly doped drain structure formed adjacent the first one of said source/drain regions of said driving transistor.

11. A driving circuit for driving an organic electroluminescence light emitting portion, comprising:

(A) a driving transistor of the n channel type having source/drain regions, a channel formation region and a gate electrode;

(B) an image signal writing transistor having source/drain regions, a channel formation region and a gate electrode; and (C) a capacitor element having a pair of electrodes;

said driving transistor being configured such that (A-1) a first one of said source/drain regions is connected to a power supply section, that (A-2) a second one of said source/drain regions is connected to an anode electrode provided on the organic electroluminescence light emitting portion and also to one of the electrodes of said capacitor element in such a manner as to form a second node, and that (A-3) the gate electrode is connected to the second one of said source/drain regions of said image signal writing transistor and also to the other electrode of said capacitor element in such a manner as to form a first node;

said image signal writing transistor being configured such that (B-1) a first one of said source/drain regions is connected to a data line, and (B-2) the gate electrode is connected to a scanning line;

said driving circuit further including (D) a first node initializing transistor having source/drain regions, a channel formation region and a gate electrode;

said first node initializing transistor being configured such that (D-1) a first one of the source/drain regions is connected to a first node initializing voltage supply line, that (D-2) a second one of the source/drain regions is connected to the first node, and that (D-3) the gate electrode is connected to a first node initializing transistor control line;

a first voltage for supplying current toward the organic electroluminescence light emitting portion through said driving transistor and a second voltage for preventing a potential difference between the second node and a cathode electrode provided on the organic electroluminescence light emitting portion from exceeding a threshold voltage of the organic electroluminescence light emitting portion being selectively applied from the power supply section to the first one of said source/drain regions of said driving transistor; and a lightly doped drain structure being formed adjacent the first one of said source/drain regions of said driving transistor.

12. The driving circuit for driving an organic electroluminescence light emitting portion according to claim 11, wherein a second lightly doped drain structure is formed adjacent the second one of said source/drain regions of said driving transistor and has a length smaller than that of the lightly doped drain structure formed adjacent the first one of said source/drain regions of said driving transistor.

13. A driving method for an organic electroluminescence light emitting portion using a driving circuit for driving the organic electroluminescence light emitting portion, the organic electroluminescence light emitting portion including (A) a driving transistor of the n channel type having source/drain regions, a channel formation region and a gate electrode, (B) an image signal writing transistor having source/drain regions, a channel formation region and a gate electrode, and (C) a capacitor element having a pair of electrodes, the driving transistor being configured such that (A-1) a first one of the source/drain regions is connected to a power supply section; that (A-2) a second one of the source/drain regions is connected to an anode electrode provided on the organic electroluminescence light emitting portion and also to one of the electrodes of the capacitor element in such a manner as to form a second node, and that (A-3) the gate electrode is connected to the second one of the source/drain regions of the image signal writing transistor and also to the other electrode of the capacitor element in such a manner as to form a first node;

the image signal writing transistor being configured such that (B-1) a first one of the source/drain regions is connected to a data line, and (B-2) the gate electrode is connected to a scanning line;

a first voltage for supplying current toward the organic electroluminescence light emitting portion through the driving transistor and a second voltage for preventing a potential difference between the second node and a cathode electrode provided on the organic electroluminescence light emitting portion from exceeding a threshold voltage of the organic electroluminescence light emitting portion being selectively applied from the power supply section to the first one of the source/drain regions of the driving transistor, and a lightly doped drain structure being formed adjacent the first one of the source/drain regions of the driving transistor;

said driving method for an organic electroluminescence light emitting portion comprising the steps of:

(a) carrying out a pre-process of applying a first node initializing voltage from the data line to the first node through the image signal writing transistor, which is placed in an on state by a signal from the scanning line, so that the potential difference between the first node and the second node may exceed a threshold voltage of the driving transistor and applying a second voltage from the power supply section to the first one of the source/drain regions of the driving transistor;

(b) carrying out a threshold voltage cancellation process of applying, in a state wherein the first node initializing voltage remains applied from the data line to the first node through the image signal writing transistor which maintains the on state in response to a signal from the scanning line, the first voltage from the power supply section to the first one of the source/drain regions of the driving transistor to cause the potential at the second node to vary toward the potential of the difference of the threshold voltage of the driving transistor from the potential at the first node in a state wherein the potential at the first node is maintained;

(c) carrying out a writing process of applying the image signal from the data line to the first node through the image signal writing transistor, which is placed in an on state by a signal from the scanning line; and (d) carrying out a process of placing the image signal writing transistor into an off state in accordance with a signal from the scanning line to place the first node into a floating state and supplying current according to the value of the potential difference between the first node and the second node from the power supply section to the organic electroluminescence light emitting portion through the driving transistor.

14. The driving method for an organic electroluminescence light emitting portion according to claim 13, wherein a second lightly doped drain structure is formed adjacent the second one of said source/drain regions of said driving transistor and has a length smaller than that of the lightly doped drain structure formed adjacent the first one of said source/drain regions of said driving transistor.

* * * * *